US010992061B2

(12) United States Patent
Garrec et al.

(10) Patent No.: US 10,992,061 B2
(45) Date of Patent: Apr. 27, 2021

(54) ELEMENTARY ANTENNA COMPRISING AMPLIFICATION CHAINS FOR DELIVERING SIGNALS TO AND AMPLIFYING SIGNALS ARISING FROM A PLANAR RADIATING DEVICE THEREOF

(71) Applicants: THALES, Courbevoie (FR); UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR)

(72) Inventors: Patrick Garrec, Pessac (FR); Anthony Ghiotto, Talence (FR); Gwenaël Morvan, Elancourt (FR)

(73) Assignees: THALES, Courbevoie (FR); UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 0 days.

(21) Appl. No.: 16/478,406

(22) PCT Filed: Feb. 1, 2018

(86) PCT No.: PCT/EP2018/052584
§ 371 (c)(1),
(2) Date: Jul. 16, 2019

(87) PCT Pub. No.: WO2018/141882
PCT Pub. Date: Aug. 9, 2018

(65) Prior Publication Data

US 2019/0372239 A1 Dec. 5, 2019

(30) Foreign Application Priority Data

Feb. 1, 2017 (FR) ..... 1700103

(51) Int. Cl.
*H01Q 9/04* (2006.01)
*H01Q 21/24* (2006.01)
*H01Q 21/06* (2006.01)

(52) U.S. Cl.
CPC ..... *H01Q 21/245* (2013.01); *H01Q 9/0435* (2013.01); *H01Q 9/0457* (2013.01); *H01Q 21/065* (2013.01)

(58) Field of Classification Search
CPC .. H01Q 21/006; H01Q 21/065; H01Q 9/0435; H01Q 9/045
(Continued)

(56) References Cited

U.S. PATENT DOCUMENTS 5,280,297 A 1/1994 Profera, Jr.
5,936,588 A * 8/1999 Rao ..... H01Q 3/24 342/372
(Continued)

FOREIGN PATENT DOCUMENTS

EP 2 093 832 A1 8/2009

OTHER PUBLICATIONS

European Search Report issued in European Patent Application No. 18 701 506.0 dated Mar. 1, 2021.

*Primary Examiner* — Andrea Lindgren Baltzell
*Assistant Examiner* — Jianzi Chen
(74) *Attorney, Agent, or Firm* — BakerHostetler

(57) ABSTRACT

An elementary antenna includes a planar radiating device comprising a substantially plane radiating element and a transmit and/or receive circuit comprising at least one amplification chain of a first type and at least one amplification
(Continued)

chain of a second type, each amplification chain of the first type being coupled to at least one excitation point of a first set of at least one excitation point of the radiating element and each amplification chain of the second type being coupled to at least one point of a second set of points, the excitation points of the first and second set being distinct and the amplification chain of the first type being different from the amplification chain of the second type so that they exhibit different amplification properties.

22 Claims, 19 Drawing Sheets

(58) Field of Classification Search
USPC ..... 343/824, 852, 857
See application file for complete search history.

(56) References Cited

U.S. PATENT DOCUMENTS

| | | | | |
|---|---|---|---|---|
| 7,760,152 | B2 * | 7/2010 | Seppa | H01Q 9/30 343/745 |
| 8,111,640 | B2 * | 2/2012 | Knox | H01Q 1/24 370/278 |
| 8,294,615 | B2 * | 10/2012 | Caille | H01Q 3/26 342/368 |
| 9,083,293 | B2 * | 7/2015 | Chien | H03F 1/56 |
| 9,780,437 | B2 * | 10/2017 | Knox | H04B 1/525 |
| 2009/0289862 | A1 | 11/2009 | Seppae | |
| 2010/0099367 | A1 | 4/2010 | Shamim et al. | |
| 2012/0188917 | A1 | 7/2012 | Knox | |
| 2012/0295556 | A1 | 11/2012 | Chien et al. | |
| 2015/0340759 | A1 | 11/2015 | Bridgelall et al. | |
| 2019/0173500 | A1 * | 6/2019 | Artemenko | H01Q 1/247 |

* cited by examiner

| 1a+ | 1a- | 2a- | 2a+ | 3a- | 3a+ | 4a+ | 4a- | Polarisation |
|---|---|---|---|---|---|---|---|---|
| 180° | 0° | 0° | 180° | 0° | 180° | 180° | 0° | Vertical |
| 180° | 0° | 180° | 0° | 0° | 180° | 0° | 180° | Horizontal |
| 180° | 0° | OFF | OFF | 0° | 180° | OFF | OFF | +45° |
| OFF | OFF | 0° | 180° | OFF | OFF | 180° | 0° | -45° |
| 180° | 0° | 90° | 270° | 0° | 80° | 270° | 90° | Right Circular (RCP) |
| 180° | 0° | 270° | 90° | 0° | 80° | 90° | 270° | Left Circular (LCP) |

FIG.6

| 1a+ | 1a- | 2a+ | 2a- | Polarisation |
|---|---|---|---|---|
| 180° | 0° | 180° | 0° | Vertical |
| 180° | 0° | 0° | 180° | Horizontal |
| 180° | 0° | OFF | OFF | +45° |
| OFF | OFF | 180° | 0° | -45° |
| 180° | 0° | 270° | 90° | Right Circular (RCP) |
| 180° | 0° | 90° | 270° | Left Circular (LCP) |

FIG.9

ELEMENTARY ANTENNA COMPRISING AMPLIFICATION CHAINS FOR DELIVERING SIGNALS TO AND AMPLIFYING SIGNALS ARISING FROM A PLANAR RADIATING DEVICE THEREOF

CROSS-REFERENCE TO RELATED APPLICATIONS

This application is a National Stage of International patent application PCT/EP2018/052584, filed on Feb. 1, 2018, which claims priority to foreign French patent application No. FR 1700103, filed on Feb. 1, 2017, the disclosures of which are incorporated by reference in their entirety.

FIELD OF THE INVENTION

The present invention pertains to the field of array antennas and notably active antennas. It applies notably to radars, to electronic warfare systems (such as radar detectors and radar jammers) as well as to communication systems or other multifunction systems.

BACKGROUND

A so-called array antenna comprises a plurality of antennas that may be of the planar type that is to say of the printed circuit type and often called patch antennas. The technology of planar antennas makes it possible to produce slender, directional antennas by producing the radiating elements by etching metallic patterns on a dielectric layer furnished with a metallic ground plane at the rear face. This technology leads to very compact directional electronic-scanning antennas that are simpler to produce and therefore less expensive than Vivaldi-type antennas.

An active antenna conventionally comprises a set of elementary antennas each comprising a substantially plane radiating element coupled to a transmit/receive module (or T/R circuit for "Transmit/Receive circuit"). Each transmit/receive circuit is linked to an excitation point. Each transmit/receive circuit comprises, in electronic warfare applications, a power amplification chain which amplifies an excitation signal received from centralized signal-generating electronics and excites the excitation point as well as a low noise amplification chain which amplifies, in receive mode, a reception signal, of low level, received by the radiating element at the level of the excitation point and sends it to a concentration circuit which sends it to a centralized acquisition circuit.

Array antennas of this type exhibit a certain number of drawbacks. Indeed, the low noise amplification chains exhibit different optimal input impedances from the optimal output impedances of the power amplification chains. Usually, the impedance of the excitation points is adjusted to 50 Ohms, since the instrumentation equipment is provided for this impedance. However, this is not the optimal impedance for HPA power amplifiers (with reference to the expression "High Power Amplifier") or for LNA low noise amplifiers (with reference to the expression "Low Noise Amplifier"). To alleviate this drawback, it is customary to dispose an impedance transformer at the output of the power amplification chain and at the input of the low noise amplification chain. This transformer leads to less good efficiency in transmission, giving rise to significant energy losses resulting in thermal dissipation. It also leads to a less good noise figure NF in reception, the signal-to-noise ratio of the received signal being degraded.

One might be required to transmit signals exhibiting different powers by means of one and the same array antenna. One may for example transmit high-power so-called radar signals exhibiting a narrow frequency spread band (of the narrowband type i.e. 10 to 20% of the central frequency) and telecommunication, or radar jamming, signals exhibiting a wide frequency spread band (of the wideband type whose spread band may be up to three octaves) and a lower power. These signals may be transmitted simultaneously or in a sequential manner. A planar radiating device in MMIC (for "Monolithic Microwave Integrated Circuit") technology is for example known, comprising a transformer produced in the MMIC and enabling these two types of signals to be amplified in terms of frequency and power as a function of the spread bandwidths and of the powers required and enabling them to be summed before injecting them onto an antenna at one and the same excitation point.

This solution exhibits drawbacks however. This type of transformer with signal summator integrated upstream of the radiating element, in the MMIC, is voluminous and gives rise to significant energy losses. In order to limit the heating of the integrated circuit, it is indispensable to cool it, thus requiring specific equipment and involving significant energy consumption.

SUMMARY OF THE INVENTION

An aim of the invention is to propose a planar radiating device which makes it possible to obtain an antenna in which at least one of the aforementioned drawbacks is reduced.

To this effect, a subject of the invention is an elementary antenna comprising a planar radiating device comprising a substantially plane radiating element and a transmit and/or receive circuit comprising at least one amplification chain of a first type and at least one amplification chain of a second type, each amplification chain of the first type being coupled to at least one excitation point of a first set of at least one excitation point of the radiating element and each amplification chain of the second type being coupled to at least one point of a second set of excitation points of the radiating element, the excitation points of the first and second set being distinct and the amplification chain of the first type being different from the amplification chain of the second type so that they exhibit different amplification properties.

Advantageously, the excitation points of the first set and of the second set exhibiting distinct impedances.

According to a first embodiment of the invention, the antenna comprises a transmit and receive circuit, said transmit and receive circuit comprising:

at least one transmit amplification chain able to deliver signals intended to excite the radiating element, each transmit amplification chain being coupled to at least one point of the first set of at least one excitation point of said radiating element;

at least one receive amplification chain able to amplify signals arising from the radiating element, each receive amplification chain being coupled to at least one point of the second set of at least one excitation point of said radiating element.

Advantageously, the excitation points are positioned and coupled to the respective amplification chains in such a way that each amplification chain is loaded substantially by its optimal impedance, the impedance loaded on each amplification chain being the impedance of the chain formed by the radiating device coupled to the amplification chain and by each feed line linking the radiating device to the amplification chain.

Advantageously, at least one transmit amplification chain coupled to one point or two points of the first set exhibits an output impedance which is substantially the conjugate of the radiating device's impedance presented to said transmit amplification chain, at said point or between the two points of the first coupled set; and/or at least one receive amplification chain coupled to one point or two points of the first set exhibits an output impedance substantially conjugate to the radiating device's impedance presented to said amplification chain in reception at said point or between the two points of the second coupled set.

According to a second embodiment of the invention, the elementary antenna comprises a transmit circuit, the transmit circuit comprising:

at least one so-called high-power transmit amplification chain able to deliver signals intended to excite the radiating element, each high-power transmit amplification chain being coupled to at least one point of the first set of at least one excitation point of said radiating element;

at least one second so-called low-power transmit amplification chain, of lower power than the first power amplification chain, able to deliver signals intended to excite the radiating element, each low-power transmit amplification chain being coupled to at least one point of the second set of at least one excitation point of said radiating element.

Advantageously, the excitation points are positioned and coupled to each high-power transmit amplification chain in such a way that each high-power amplification chain is loaded substantially by its optimal impedance, the impedance loaded on each high-power amplification chain being the impedance of the chain formed by the radiating device coupled to the amplification chain and by each feed line coupling the radiating device to the high-power transmit amplification chain.

Advantageously, at least one high-power transmit amplification chain coupled to one point or two points of the first set exhibits an output impedance which is substantially the conjugate of the radiating device's impedance presented to said transmit amplification chain at said point or between the two points of the first set.

The two embodiments can comprise one or more of the following characteristics, taken in isolation or in accordance with all the technically possible combinations:

the impedance of each excitation point of the first set is less than the impedance of each excitation point of the second set, the radiating element is defined by a first straight line passing through a central point of the radiating element and a second straight line perpendicular to the first straight line and passing through the central point, the excitation points being distributed solely over the first and/or on the second straight line, the radiating device comprises two slots extending longitudinally according to the first straight line and the second straight line, the two slots ensuring the coupling of all the excitation points, at least one set taken from among the first set and the second set comprises at least one pair of excitation points, the pair of excitation points comprising two excitation points coupled to the transmit and/or receive circuit in such a way that a differential signal is intended to flow between the radiating device and the transmit circuit, at least one set taken from among the first set and the second set comprises a first quadruplet of excitation points, the radiating element being defined by a first straight line passing through a center of the radiating element and a second straight line perpendicular to the first straight line and passing through the center, the excitation points of each first quadruplet of excitation points comprise a first pair of excitation points composed of excitation points disposed in a substantially symmetric manner with respect to said first straight line and a second pair of excitation points composed of excitation points disposed in a substantially symmetric manner with respect to said second straight line, the excitation points of the first quadruplet of points are situated some distance from the first straight line and from the second straight line, each set comprises a first quadruplet of excitation points situated on the first straight line and on the second straight line, each set consists of a first quadruplet of points, the excitation points of each first quadruplet of points being situated on just one side of a third straight line situated in the plane defined by the radiating element, passing through the central point and being a bisector of the angle formed by the first and the second straight line, the set comprises a second quadruplet of excitation points situated some distance from the first straight line and from the second straight line comprising:

- a third pair composed of excitation points disposed in a substantially symmetric manner with respect to said first straight line, the points of the third pair of points being disposed on the other side of the second straight line with respect to the first pair of excitation points of said set,
- a fourth pair composed of excitation points disposed in a substantially symmetric manner with respect to said second straight line, the points of the fourth pair of points being disposed on the other side of the first straight line with respect to the second pair of excitation points of said set, each set taken from among the first set and the second set comprises a first and a second quadruplet of points, the antenna comprises phase-shifting means making it possible to introduce a first phase-shift between a first signal applied, or arising from, the first pair of the excitation points and a second signal applied to, or respectively arising from, the second pair of excitation points and a second phase-shift of said set, which may be different from the first phase-shift, between a third signal applied to, or respectively arising from, the third pair or arising from the third pair of excitation points of said set and a fourth signal applied to, or respectively arising from, the fourth pair of excitation points of said set, the first quadruplet of points and the second quadruplet of points of at least one set being excited by means of signals of distinct frequencies or being summed separately.

Advantageously, generally applicable notably to both embodiments, each amplification chain of the first type is associated with an amplification chain of the second type, these amplification chains being coupled to excitation points disposed so as to transmit or receive respective elementary waves linearly polarized in one and the same direction. Stated otherwise, this direction is common to the mutually associated amplification chains.

The invention also pertains to an antenna comprising several elementary antennas as claimed in any one of the preceding claims, in which the radiating elements form an array of radiating elements.

Advantageously, the antenna comprises pointing phase-shifting means make it possible to introduce first global phase-shifts between signals applied to the, or arising from the, first quadruplets of points of at least one set of points of the respective elementary antennas and second global phase-shifts between signals applied to the, or respectively arising from the, second quadruplets of points of said set of points of the respective elementary antennas, it being possible for the first and the second global phase-shifts to be different.

BRIEF DESCRIPTION OF THE DRAWINGS

Other characteristics and advantages of the invention will become apparent on reading the detailed description which follows, given by way of nonlimiting example and with reference to the appended drawings in which:

FIG. 6 represents a table cataloguing various polarizations that can be obtained by means of the system of FIG. 5, FIGS. 7, 8, 10 and 11 represent four other variants of the elementary antenna according to the invention FIG. 4 schematically represents an elementary antenna according to a second embodiment of the invention, FIG. 9 represents a table cataloguing various polarizations that can be obtained by means of the antenna of FIG. 8.

DETAILED DESCRIPTION

From figure to figure, the same elements are labeled by the same references.

Figure 1:
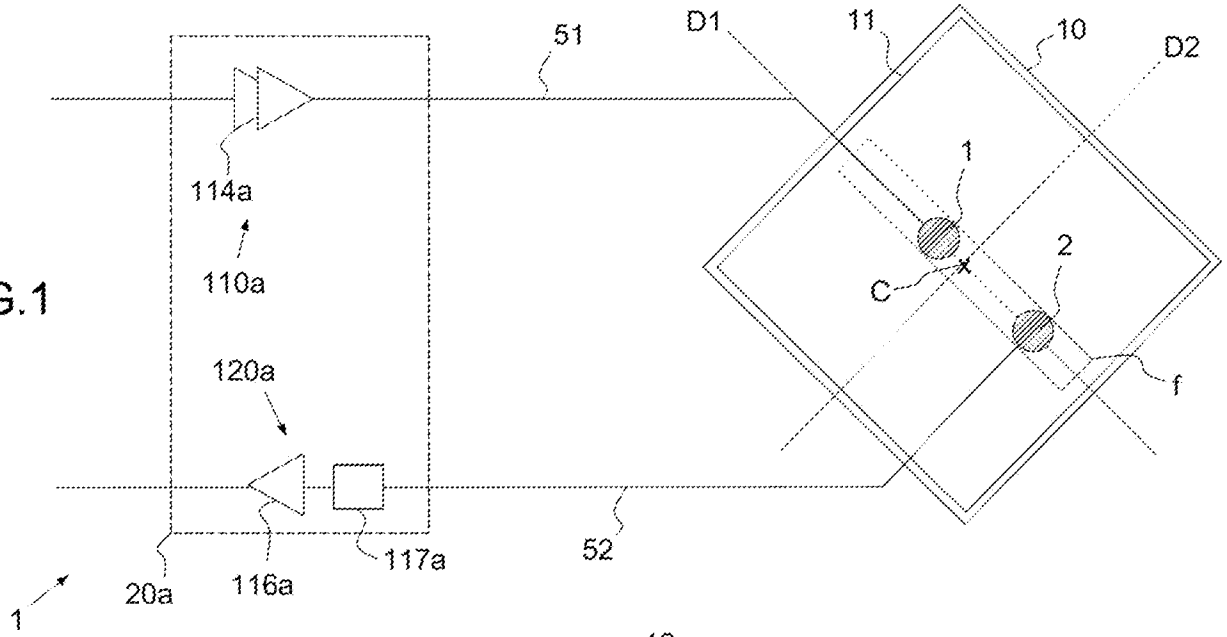
FIG. 1 schematically represents a first example of an elementary antenna according to a first embodiment of the invention.

In FIG. 1, an example has been represented of an elementary antenna 1A according to the invention comprising a planar radiating device 10 and a processing circuit or transmit/receive module 20*a*.

The planar radiating device 10 comprises a substantially plane radiating element 11, extending substantially in the plane of the sheet. The planar radiating device is a planar antenna better known by the name patch antenna.

The invention also pertains to an antenna comprising several elementary antennas according to the invention. The antenna can be of the array type. The radiating elements 11 or the planar radiating devices 10 of the elementary antennas form an array of radiating elements. Advantageously, the radiating elements are disposed in such a way that their respective radiating elements 11 are coplanar and exhibit one and the same orientation with respect to a fixed frame of the plane of the radiating elements. As a variant, the radiating elements are disposed according to another shape.

The antenna is advantageously an active antenna.

Figure 2:
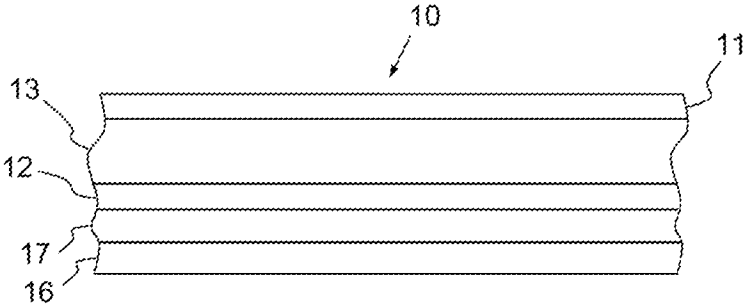
FIG. 2 represents an elementary antenna in side view, FIGS. 3, 4 and 5 schematically represent three variants of the elementary antenna according to the first embodiment of the invention.

The planar radiating device 10 forms a stack such as represented in FIG. 2. It comprises a substantially plane radiating element 11 disposed above a layer forming the ground plane 12, a gap is made between the radiating element 11 and the ground plane 12. This gap comprises for example an electrically insulating layer 13 for example consisting of a dielectric material. Preferably, the radiating element 11 is a plate made of conducting material. As a variant, the radiating element 11 comprises several stacked metallic plates. It conventionally exhibits a square shape. As a variant, the radiating element exhibits another shape, for example a disk shape or another parallelogram shape such as for example a rectangle or a lozenge. Irrespective of the geometry of the radiating element 11, it is possible to define a center C.

The elementary antenna comprises feed lines 51, 52, formed of conductors, that is to say of tracks, coupled with the radiating element 11 at excitation points 1 or respectively 2 lying within the radiating element 11. This coupling allows the excitation of the radiating element 11.

The tracks are for example tuned in frequency.

The coupling is for example carried out by slot-wise electromagnetic coupling. The planar radiating device 10 then comprises a feed plane 16, visible in FIG. 2, conveying ends of the feed lines. The plane 16 is being advantageously separated from the ground plane 12 by a layer of insulating material 17, for example a dielectric. The planar radiating device 10 also comprises at least one slot f made in the layer forming the ground plane. The ends of the feed lines 51, 52 are disposed so as to overlap the corresponding slot f on the underside, the radiating element 11 being situated above the layer forming the ground plane 12. The excitation points 1 and 2 are then situated in line with the slot f and with the end of the corresponding feed line 51, 52. The feed lines are connected to the terminals of the corresponding chains. In FIG. 1, the projection of the slot f is represented dotted. In the embodiment of FIG. 1, a slot f provided for the two excitation points. As a variant, a slot is provided per excitation point or for a plurality of excitation points, for example a pair of excitation points intended to be excited in a differential manner or for several pairs. For greater clarity, the slots are not represented in all the figures. The slots are not necessarily rectangular, other shapes may be envisaged.

As a variant, the coupling is carried out by connecting the end of the feed line electrically to an excitation point of the radiating element. For example, at the end of the feed line, the excitation current flows toward the radiating element, through the insulating material, for example by means of a metallized via making it possible to connect the end of the feed line to a spigot situated at the rear of the radiating element in line with the point to be excited. The coupling can be performed on the actual plane of the plane radiating element, or "patch" by driving it directly through a microstrip printed line connected to the edge of the radiating element. The excitation point is then situated at the end of the feed line. The excitation can also be carried out by proximity coupling to a microstrip line printed at a level situated between the patch and the layer forming the ground plane.

The coupling can be carried out in the same way or in a different way for the various excitation points.

What was stated above applies to all the embodiments of the invention.

According to the invention, the radiating element 11 comprises a first set of at least one excitation point, composed of the excitation point 1 in FIG. 1, and a second set of at least one excitation point, composed of the point 2 in FIG. 1. The excitation points of the two sets are distinct. Stated otherwise, the two sets do not exhibit any common points.

The points of the two sets are coupled to signal amplification chains which are of two distinct types so that they exhibit different amplification properties. This coupling is simultaneous. Stated otherwise, these amplification chains are configured to carry out different signals processings.

They then present different optimal impedances to the radiating device or they exhibit different requirements in terms of impedance matching with the radiating device. It is for example possible to provide at least one transmit amplification chain configured to amplify a signal so as to deliver an excitation signal thereafter applied to the radiating device for one of the sets of points and at least one receive amplification chain configured to receive and amplify a reception signal arising from a reception signal arising from the other set of points. As a variant, it is possible to provide two receive amplification chains exhibiting distinct powers and therefore different requirements in terms of impedance matching.

The invention makes it possible to adjust the impedance of the excitation points of the two sets of points independently. By dedicating different excitation points to distinct functions, for example transmission and reception or the transmission of signals of high power and the transmission of signals of low power, it is possible to adapt the impedances seen by the various amplification chains independently. In the particular embodiment of FIG. 1, the transmit and receive circuit 20*a* comprises a transmit amplification chain 110*a* coupled to the point 1 making it possible to amplify signals originating from a circuit, not represented, for generating microwave signals and to deliver signals to excite the point 1 and a receive amplification chain 120*a* coupled to the point 2 to process signals arising from the point 2. The two amplification chains exhibit different amplification properties. Stated otherwise, these chains exhibit amplifiers exhibiting distinct properties. The transmit amplification chain 110*a* is for example a power amplification chain in the field of electronic warfare, comprising a transmission amplifier configured to transmit signals, for example an HPA power amplifier 114*a* (with reference to the expression "High Power Amplifier"), and the receive amplification chain comprises a measurement amplifier 116*a* configured to process signals arising from a sensor, here the radiating device 10, which is for example an LNA low noise amplifier (with reference to the expression "Low Noise Amplifier"). The coupling between each transmit or receive amplification chain and an excitation point 1 or 2 is done by means of a feed line 51 or respectively 52. This is valid in all the figures but the feed lines associated with the excitation points are not referenced in all the figures for greater clarity.

Each amplification chain is designed to have optimal performance when it is loaded (at output for a transmit amplification chain or at input for a receive amplification chain) by a well-determined optimal impedance; it has degraded performance when it is loaded by an impedance that differs from this optimal value.

The optimal input or output impedance of an amplification chain is substantially the optimal input impedance of the input amplifier or respectively the optimal output impedance of the output amplifier of the amplification chain.

Advantageously, the excitation points 1 and 2 are positioned and coupled to the respective amplification chains 110*a* or 120*a* in such a way that each amplification chain 110*a* or 120*a* is loaded substantially by its optimal impedance. There is said to be impedance matching.

Advantageously, the impedance loaded on an amplification chain 110*a* or 120*a* is the impedance of the chain formed by the radiating device 10 coupled to the amplification chain 110*a* or 120*a*, at the excitation point 1 or 2, and by each feed line 51 or 52 coupling the radiating device 10 to the amplification chain 110*a* or 120*a* at the corresponding excitation point. This chain is a source when it is coupled to a receive amplification chain and a load when it is coupled to a transmit amplification chain.

Consequently, the proposed solution makes it possible to optimize the consumption, in transmit mode, and to improve the noise figure, in receive mode. Therefore, it is possible to avoid having to make a compromise at the level of the impedance matching that might turn out to be expensive in terms of performance or to avoid providing an impedance transformer.

The advantage of such a solution is the optimized impedance matching for each of the two transmit and receive functions. It should be noted that the transmission signals are markedly stronger than the reception signals and that the amplifiers of the transmit amplification chains, notably the power amplification chains, 110*a*, have low optimal output impedances, conventionally of the order of 20 Ohms, and the amplifiers of the receive amplification chains, notably of the low-noise amplification chains 120*a*, exhibit a higher optimal output impedance, typically of the order of 100 Ohms, for which they exhibit a better noise figure.

Consequently, the points are advantageously positioned and coupled to the amplification chains in a manner the transmit amplification chain 110*a* is loaded on an impedance exhibiting a resistive part which is less than the impedance loaded on the receive amplification chain 120*a*.

The impedance matching is advantageously achieved by adjusting the positions of the excitation points.

In the particular embodiment of FIG. 1, the distance between each excitation point and the center C is adjusted so as to adjust its impedance. The distance separating each excitation point 1 and 2 from the center C varies in the same sense as its impedance. The point 1 nearer the center C than the point 2 exhibits a lower impedance than the impedance of the point 2.

More generally, in all the variants of the first embodiment, the excitation points of the first and second sets exhibit distinct impedances. These impedances are measured with respect to the ground. In the embodiments of the figures, the excitation points of the first set exhibit impedances of lower resistive parts than the impedances of the points of the second set. These impedances are measured with respect to the ground.

When these two sets exhibit distinct impedances, the excitation points of which it is composed advantageously exhibit identical impedances.

In an advantageous embodiment, the impedances of the feed lines are negligible so that the impedance loaded on an amplification chain 110*a* or 120*a* is substantially that of the radiating device 10 at the excitation point or between the excitation points coupled to the amplification chain.

Advantageously, in order to achieve optimal impedance matching, the output impedance of the transmit amplification chain 110*a* coupled to the excitation point, point 1 in FIG. 1, is substantially the conjugate of the radiating device's 10 impedance presented to said transmit amplification chain 110*a* at said point 1 and the input impedance of the receive amplification chain 120*a* coupled to the point 2 is substantially the conjugate of the radiating device's 10 impedance presented to the receive amplification chain 120*a* at the point 2 in FIG. 1. The input or output impedance of an amplification chain is substantially the input impedance of the input amplifier or respectively the output impedance of the output amplifier of the amplification chain.

The proposed solution also achieves isolation of the receive amplification chain 120*a* with respect to the wave transmitted during transmission. Indeed, the receive amplification chain 120 receives, from the signal transmitted by the point 1, only a portion equal to the ratio of the modulus of the impedance of point 1 to the modulus of the impedance of point 2. If point 1 exhibits an impedance of 20 Ohms corresponding to the optimal output impedance of the transmit amplification chain 110*a* and point 2 exhibits an impedance of 100 Ohms corresponding to the optimal input impedance of the receive amplification chain 120*a*, there is an isolation of 7 dB between the two chains 110*a* and 120*a*. It is then not necessary to provide a switch for switching between the transmit and receive modes or to provide a circulator so as to avoid saturating, or even destroying, the receive amplification chain 120*a* during transmission. One gains in terms of solidity, reliability and precision of detection (it should be noted that the switches influence the noise figure on reception, must withstand the total power and must be able to switch at the frequency of passing from the transmit mode to the receive mode). One also gains in terms of weight and cost with respect to the solutions comprising circulators. The integration of a circulator into the X-band grid is very difficult because of bulkiness. The solution also makes it possible to carry out transmission and reception simultaneously. In FIG. 1, the transmit amplification chain 110*a* comprises a single amplifier 114*a*, for example a power amplifier. As a variant, it can comprise several amplifiers. The receive amplification chain 110*a* comprises an amplifier, for example a low noise amplifier 116*a*. As a variant, it comprises several of them. The receive amplification chain 120*a* also comprises a protection means such as a limiter 117*a*, for example a PIN diode, to protect the receive amplification chain 110*a* from outside assaults. These characteristics apply to all the embodiments of the invention. Generally, according to the first embodiment of the invention, the transmit and receive circuit of the antenna comprises a transmit circuit able to deliver signals intended to excite the radiating element coupled to the first set of excitation points and a receive circuit able to process reception signals arising from the radiating element and being coupled to the second set of points. Advantageously, the transmit circuit is coupled to the first set of points and the receive circuit is coupled to the second set of points. The transmit circuit and the receive circuit are not coupled to common points. Stated otherwise, each transmit amplification chain is coupled to one or two points of the first set of points and each receive amplification chain is coupled to one or two points of the second set. The transmit and receive chains are not coupled to common points of the first and of the second set.

In the example of FIG. 1, each set comprises an excitation point 1 or 2. In an antenna variant 1*a* represented in FIG. 3, at least one of the sets of the radiating device 10*a* comprises a pair of excitation points configured to be able to be excited in a differential manner. The splitting of the excitation points makes it possible to increase the power by 3 dB in transmission with respect to the embodiment of FIG. 1, when the pair of points is linked to a transmit amplification chain, and the linearity by 3 dB in reception with respect to the embodiment of FIG. 1, when the pair of points is linked to a receive amplification chain. For one and the same received power, each receiver will receive only half the power. The receiver is thus better protected against strong fields.

As a variant, the antenna comprises at least one pair of excitation points. By pair of excitation points is meant hereinafter in the text two excitation points which are positioned and coupled to the processing circuit in such a way that the processing circuit is configured to excite the points of the pair by means of differential, that is to say balanced, signals or to process differential or balanced signals, arising from the pair of points. The points of one and the same pair are thus, at each instant, excited by opposite signals. The excitation points of a pair of excitation points are coupled to one and the same amplification chain and are the only excitation points to be coupled to this amplification chain.

Figure 3:
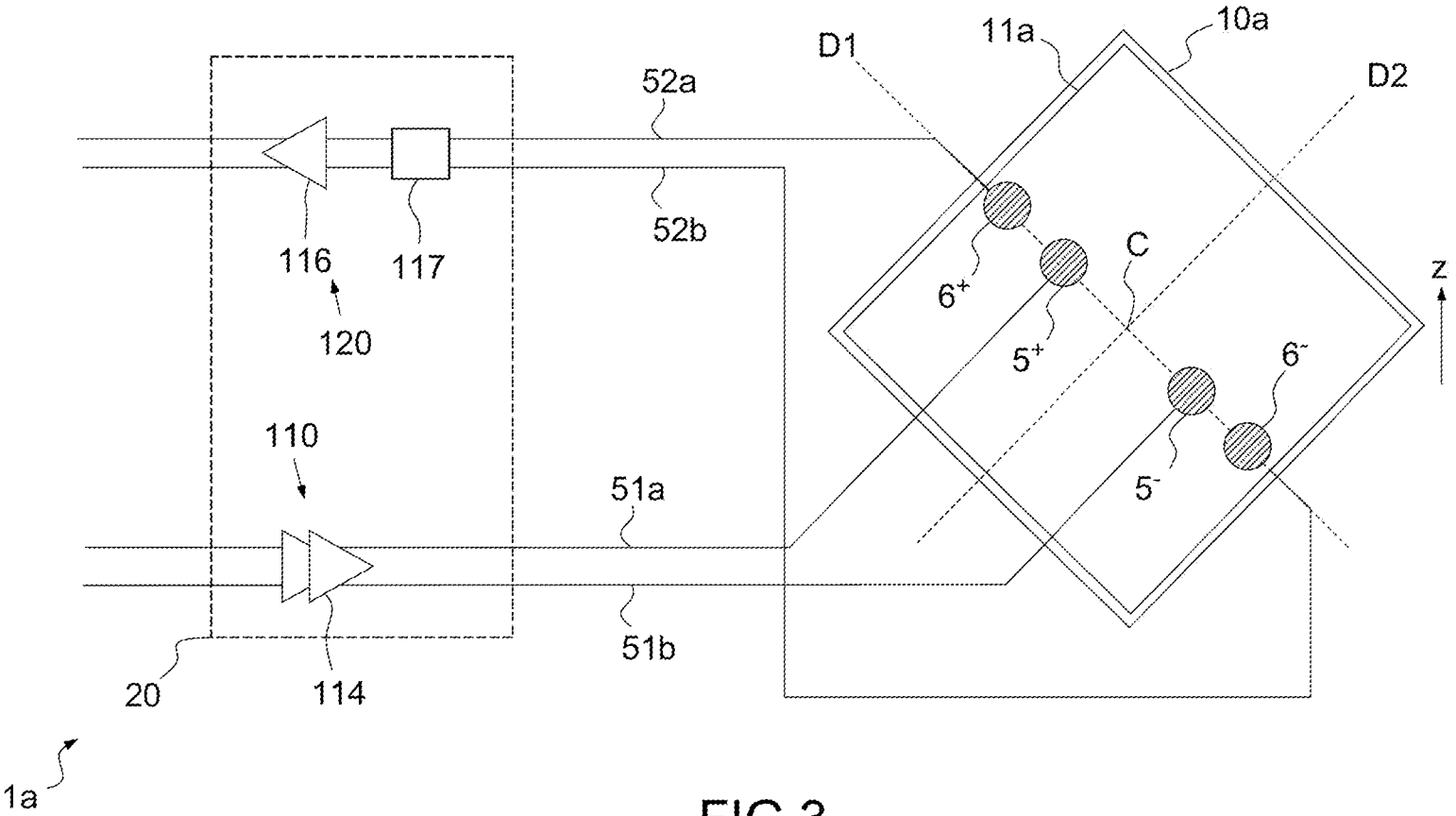

In FIG. 3, the first set of excitation points is composed of a first pair of excitation points 5+ and 5– and the second set of excitation points is composed of a first pair of excitation points 6+ and 6–. In FIG. 3, these points are situated on one and the same straight line D1 of the radiating element 11*a* of the radiating device 10*a* passing through the center C of the radiating element 11*a*. They are disposed in a substantially symmetric manner with respect to the center C so as to present the same impedance.

The processing circuit 20 or transmit/receive module comprises a transmit amplification chain 110 and a receive amplification chain 120. The points 5+ and 5– are positioned and coupled to the transmit amplification chain 110 in such a way that the transmit amplification chain excites the points 5+ and 5– by means of a differential signal. The transmit amplification chain 110 comprises a transmission amplifier 114, for example a power amplifier. The transmit amplification chain 110 is coupled to the points 5+ and 5– via respective feed lines 51*a* and 51*b*. In the nonlimiting example of FIG. 3, the chain 110 is configured to amplify two opposite injected signals, phase-shifted by 180°, received at its input. It could as a variant receive an asymmetric signal and deliver differential signals.

The receive amplification chain 120 is for example a low noise amplification chain 120 comprising a measurement amplifier 114, for example a low noise amplifier. It differs from that of FIG. 1 in that it is able to acquire differential signals. This chain 120 is coupled to the points 6+ and 6– so as to acquire differential signals arising from these points. The chain 120 makes it possible to amplify and to deliver a differential signal. As a variant, it could deliver an asymmetric signal as in FIG. 1. The chain 120 is coupled to the points 6+ and respectively 6– via respective feed lines 52*a* and 52*b*. The receive amplification chain 120 also comprises a protection means such as a limiter 117 to protect the receive amplification chain 120 from outside assaults.

Advantageously, the excitation points 5+, 5–, +, 6– are positioned and coupled to the respective amplification chains 110 or 120 in such a way that each amplification chain 110 or 120 is loaded substantially by its optimal impedance. Advantageously, the impedance loaded on an amplification chain 110 or 120 is the impedance of the chain formed by the radiating device 10 coupled to the amplification chain 110 or 120 between the excitation points 5+, 5– or 6+, 6– and by the lines 51*a* and 51*b* or 52*a* or 52*b* coupling the radiating device 10, that is to say the points 5+, 5– or 6+, 6, to the corresponding amplification chain 110 or 120.

Thus the points of the two sets exhibit distinct impedances as specified previously.

Advantageously, but not necessarily the impedance loaded on each amplification chain 110 or 120 is substantially the impedance of the radiating device 10*a* as measured between the two excitation points 5+ and 5– or 6+ and 6– coupled to the corresponding amplification chain 110 or 120.

Advantageously, as in the previous figure, the radiating device's 10 impedance presented to the transmit amplification chain between the points 5+ and 5–, that is to say the differential impedance of the radiating device 10*a* between these points, is substantially the conjugate of the output impedance of the receive amplification chain 110 and the radiating device's 10*a* impedance presented to the receive amplification chain between the points 6+ and 6− is substantially equal to the input impedance the receive amplification chain 120. These impedances are real.

Figure 4:
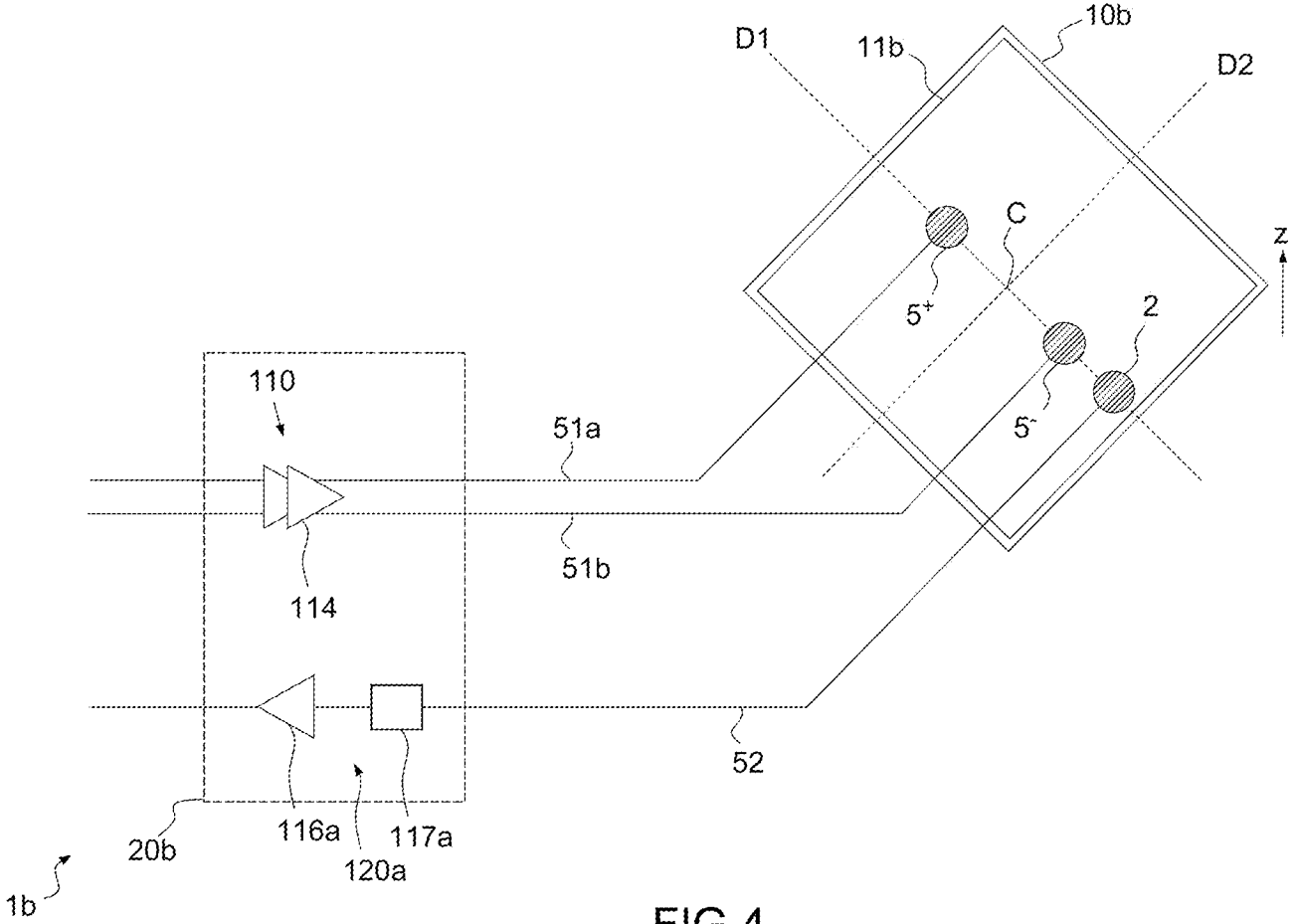

In FIG. 4, an antenna 1*b* which is a variant of FIG. 3 has been represented. This variant, differs from that of FIG. 3 in that one of the sets, here the first set, is composed of a pair of excitation points 5+, 5− excited in a differential manner as in FIG. 3 and the other set of points, here the second set is composed of an excitation point which is the point 2 excited in an asymmetric manner as in FIG. 1.

Figure 11:
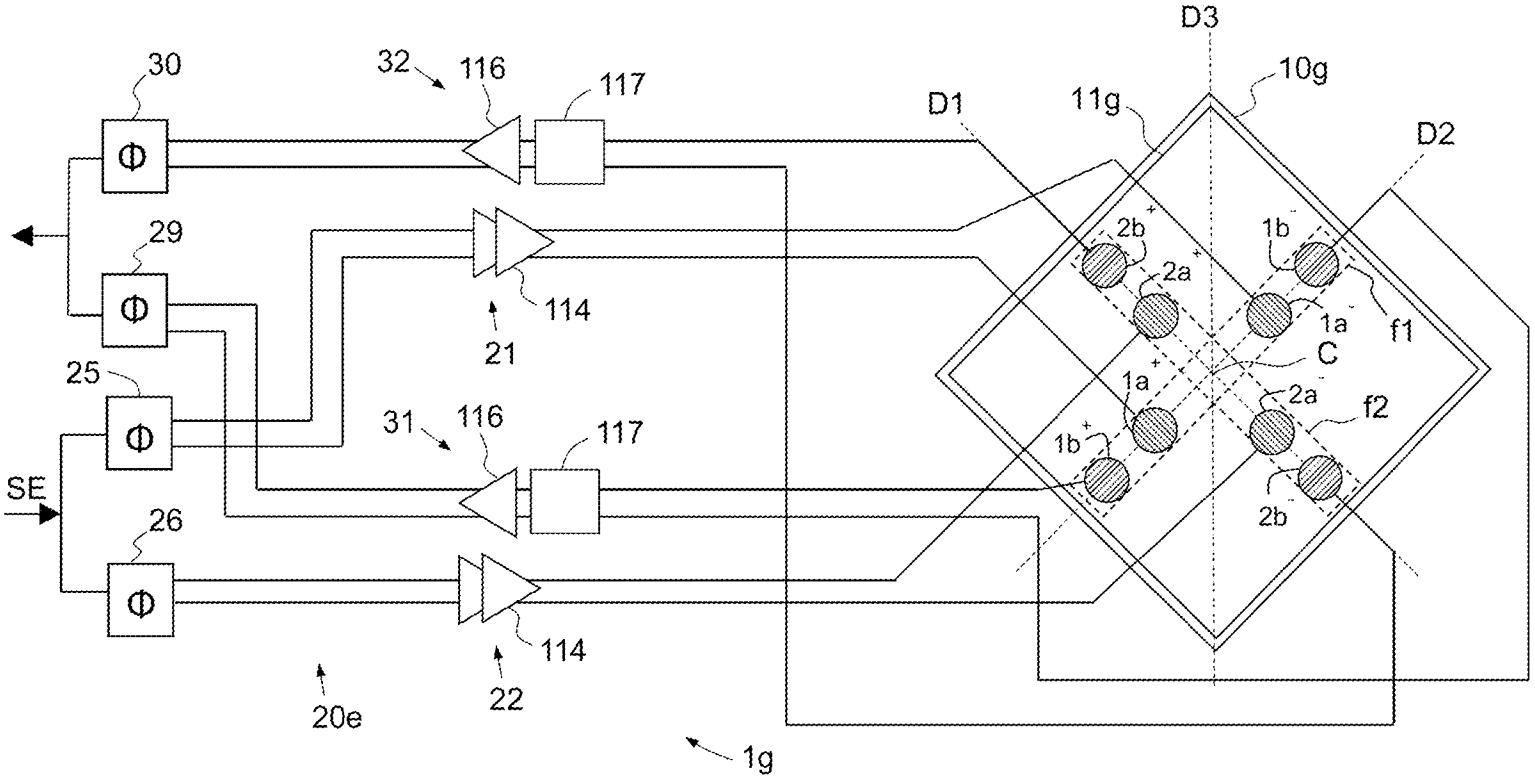
Figure 12:
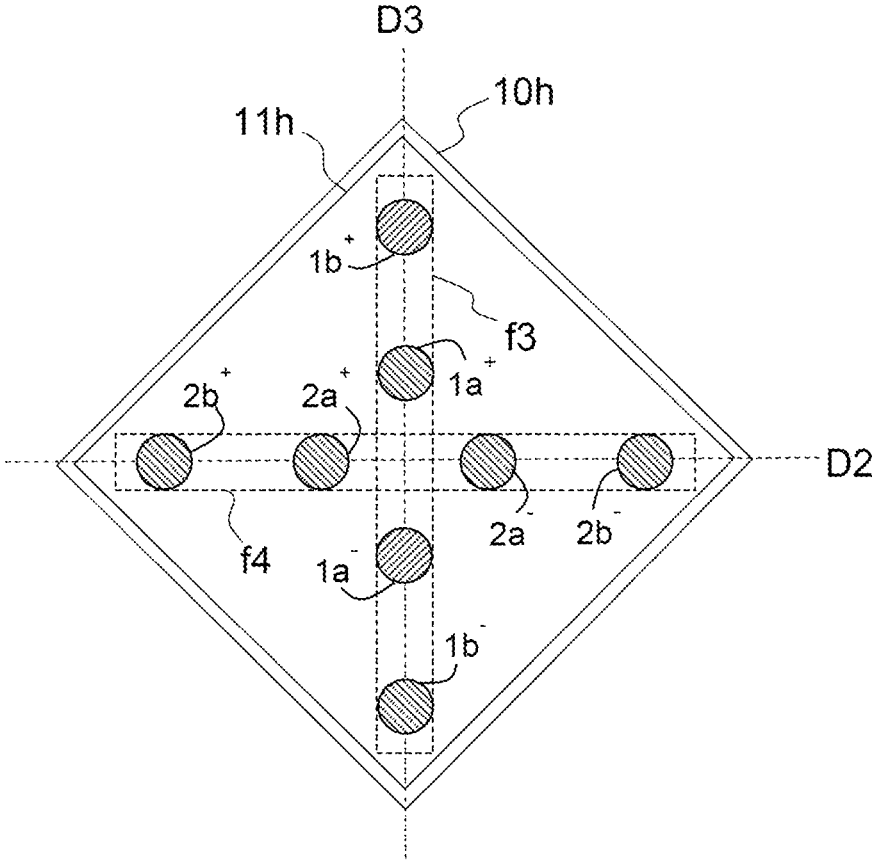
FIG. 12 represents an exemplary planar radiating device according to the invention.

In FIGS. 1, 3 and 4, the excitation points of the first and of the second set are disposed on one and the same straight line D1 of the radiating element passing through the center C of the radiating element. This makes it possible to achieve the excitation of all the points by means of a single slot f represented in FIG. 1 extending along the straight line D1 and thus a certain ease of embodiment. In the embodiment of the figures, this straight line D1 is parallel to one of the sides of the radiating element 11. As a variant, all the excitation points are disposed on a straight line passing through the center of the radiating element 11 and two vertices of the radiating element 11. As a variant, at least one of the sets of points of the two respective sets are disposed according to or in proximity to two orthogonal respective sides of the radiating element 11. As a variant, the points of two respective sets are disposed on two orthogonal straight lines passing through the center C as represented in FIGS. 11 and 12 which will be described subsequently. The coupling of all the points can be achieved by means of only two slots extending along the respective straight lines.

Figure 5:
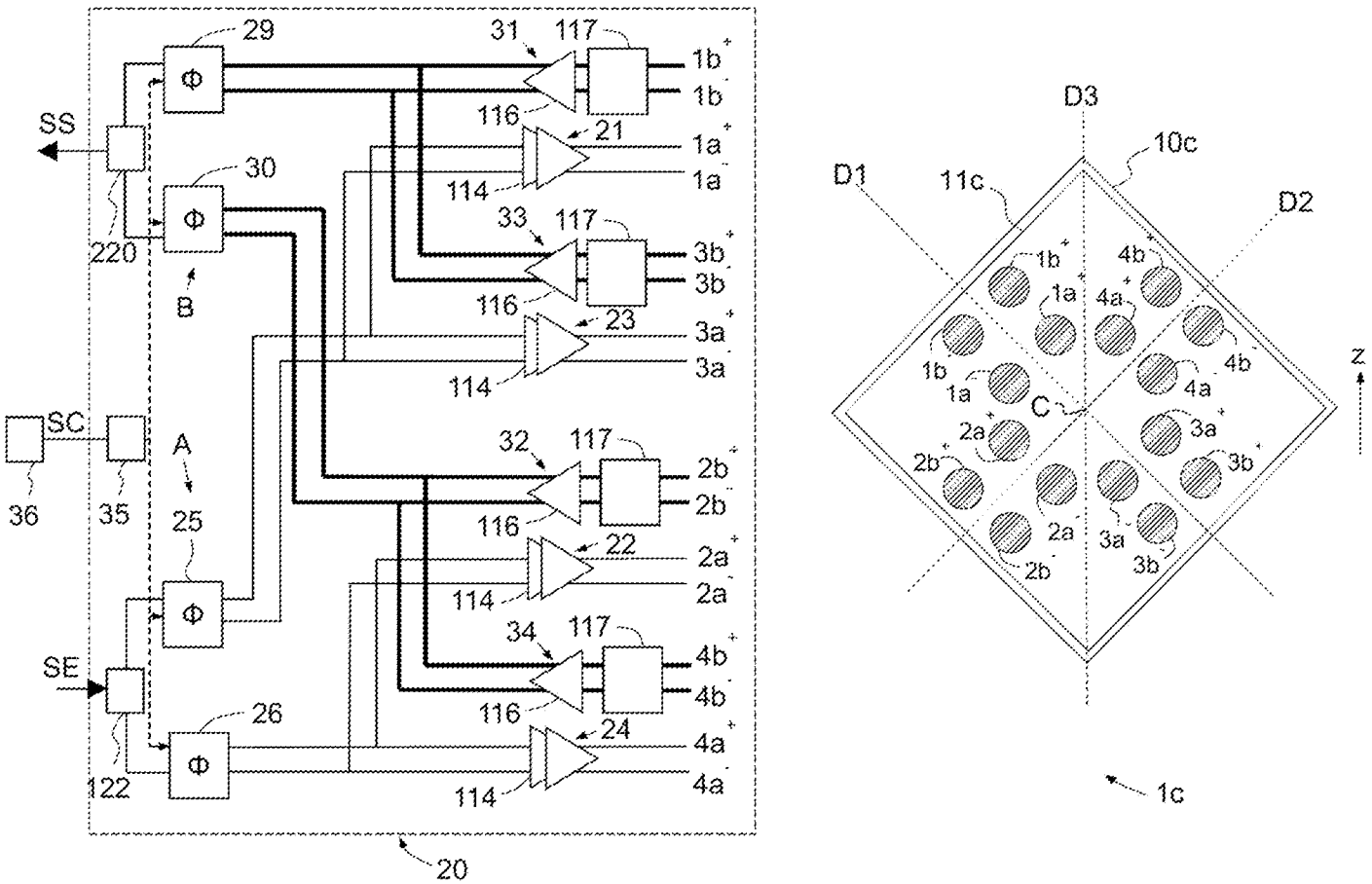

In a variant represented in FIG. 5, each set comprises two quadruplets of excitation points 1*a*+, 1*a*−, 2*a*+, 2*a*− and 3*a*+, 3*a*−, 4*a*+, 4*a*− and respectively 1*b*+, 1*b*−, 2*b*+, 2*b*− and 3*b*+, 3*b*−, 4*b*+, 4*b*−. Each quadruplet of points comprises two pairs of excitation points, arranged according to respective orthogonal straight lines, the excitation points of each pair of excitation points being arranged so as to be able to be excited in a differential manner.

In the precise example of FIG. 5, the plane of the radiating element 11*c* of the planar radiating device 10*c* is defined by two orthogonal directions. These two directions are the first straight line D1 and the second straight line D2. Each of these orthogonal directions passes through the center C. In the nonlimiting embodiment of FIGS. 5 to 10, these straight lines are parallel to the respective sides of the radiating element, which is rectangular. This rectangle is a square, in the nonlimiting example of these figures.

The first set of excitation points comprises a first quadruplet of excitation points which are all situated some distance from the straight lines D1 and D2, that is to say which are all remote from these straight lines D1 and D2, said first quadruplet of points comprising:

- a first pair of excitation points 1*a*+, 1*a*− composed of an excitation point 1*a*+ and of an excitation point 1*a*− disposed in a substantially mutually symmetric manner with respect to the first straight line D1,
- a second pair of excitation points 2*a*+, 2*a*− composed of an excitation point 2*a*+ and of an excitation point 2*a*− disposed in a substantially mutually symmetric manner with respect to the second straight line D2.

The first set of excitation points comprises a second quadruplet of excitation points which are all situated some distance from the straight lines D1 and D2, the second quadruplet of points comprising:

- a third pair of excitation points 3*a*+, 3*a*− composed of an excitation point 3*a*+ and an excitation point 3*a*− disposed in a substantially symmetric manner with respect to the first straight line D1, the excitation points 3*a*+ and 3*a*− of the third pair of points being disposed on the other side of the second straight line D2 with respect to the first pair of excitation points 1*a*+, 1*a*−,
- a fourth pair of excitation points 4*a*+, 4*a*− comprising an excitation point 4*a*+ and an excitation point 4*a*− disposed in a substantially symmetric manner with respect to the second straight line D2, the excitation points 4*a*+ and 4*a*− of the fourth pair of points being disposed on the other side of the first straight line D1 with respect to the second pair of excitation points 2*a*+, 2*a*−.

The points of each pair are substantially mutually symmetric by orthogonal symmetry with axis D1 or D2.

The excitation points of each of the two quadruplets of points are distinct. Stated otherwise, the two quadruplets of points do not exhibit any excitation points in common. The various pairs do not exhibit any excitation points in common.

The second set comprises a first quadruplet of points comprising a first pair 1*b*+, 1*b*− and a second pair 2*b*+, 2*b*− exhibiting the same characteristics, listed hereinabove, as the first quadruplet points 1*a*+, 1*a*−, 2*a*+, 2*a*− of points of the first set, but different impedances from the impedances of the first quadruplet of points. The second set also comprises a second quadruplet of points comprising a third pair 3*b*+, 3*b*− and a fourth pair 4*b*+, 4*b*− exhibiting the same characteristics, listed hereinabove, as the second quadruplet of points 3*a*+, 3*a*−, 4*a*+, 4*a*− of the first set, but different impedances.

Advantageously, the points of a pair of excitation points are disposed so as to exhibit identical impedances measured with respect to the ground so as to be able to be excited in a differential manner. Advantageously, all the points of one and the same set exhibit the same impedance. To this end, in the embodiment of FIG. 5 in which the radiating element 11 is square and the straight lines D1 and D2 are parallel to the respective sides of the squares, the points of one and the same set of points are situated substantially at one and the same distance from the center C and one and the same distance separates the points of each pair of this set. The first and the third pair of each set are then mutually symmetric with respect to the straight line D2 and the second and the fourth pair of each set are mutually symmetric with respect to the straight line D1.

The points of the first set exhibit lower impedances than the points of the second set. To this end, in the example of FIG. 5, the points of each pair of points are separated by one and the same distance, and the points of the first set are closer to the center that those of the second set.

The transmit/receive module 20*c* of the antenna 1*c* comprises a transmit circuit A comprising four transmit amplification chains 21 to 24 identical to the chain 10 of FIG. 3. Each transmit amplification chain 21, 22, 23 or 24 is coupled to a pair of excitation points 1*a*+ and 1*a*−, 2*a*+ and 2*a*−, 3*a*+ and 3*a*− or respectively 4*a*+ and 4*a*− of the first set of excitation points and is able to apply a differential excitation signal to the pair of excitation points. The transmit/receive module 20*c* comprises a receive circuit B comprising four receive amplification chains 31 to 34 identical to the low noise amplification chain 120 of FIG. 3. Each receive amplification chain 31 to 34 is coupled to one of the pairs of excitation points 1*b*+ and 1*b*−, 2*b*+ and 2*b*−, 3*b*+ and 3*b*− or respectively 4*b*+ and 4*b*− of the second set of excitation points and is able to acquire and to process differential reception signals arising from this pair.

The pair of points 1*a*+ and 1*a*− coupled to the chain 21 is intended to transmit an elementary wave linearly polarized in the direction of D2 just like the pair of points 3*a*+, 3*a*− coupled to the chain 23 while the pairs 2*a*+, 2*a*− and 4*a*+, 4*a*− coupled respectively to the chains 22 and 24 are intended to transmit respective elementary waves linearly polarized in the direction of the straight line D1.

The pairs of points 1*b*+ and 1*b*− which are coupled to the chain 31 is intended to detect an elementary wave linearly polarized in the direction of D2 just like the pair of points 3*b*+, 3*b*− which is coupled to the chain 33 while the pairs 2*b*+, 2*b*− and 4*b*+, 4*b*− which is coupled respectively to the chains 32 and 34 are intended to detect elementary waves linearly polarized in the direction of the straight line D1.

Advantageously, the excitation points are positioned and coupled to the respective amplification chains 21 to 24 and 31 to 34 in such a way that each amplification chain 21 to 24 and 31 to 34 is loaded substantially by its optimal impedance. Advantageously, the impedance loaded on an amplification chain 21, 22, 23, 24, 31, 32, 33, 34 is the impedance of the chain formed by the radiating device 10 coupled to the amplification chain, between the two excitation points 1*a*+ and 1*a*− or 2*a*+ and 2*a*−, 4*b*+ and 4*b*− and by the feed lines linking the radiating device 10*c* to the corresponding amplification chain.

Advantageously, but not necessarily, the impedance loaded on each amplification chain, for example 21, is substantially the impedance of the radiating device 10*c* as measured between the two excitation points 1*a*+ and 1*a*−, coupled to the amplification chain 21 and the corresponding amplification chain 21.

Advantageously, the radiating device's 10 impedance presented to each transmit amplification chain 21, 22, 23 and respectively 24 between the respective pairs of points of the first set 1*a*+ and 1*a*−, 2*a*+ and 2*a*−, 3*a*+ and 3*a*− and respectively 4*a*+ and 4*a*− exhibits a resistive part that is smaller than the radiating device's 10 impedance presented to each receive amplification chain 31, 32, 33 and 34 between each points pair 1*b*+ and 1*b*−, 2*b*+ and 2*b*−, 3*b*+ and 3*b*− and respectively 4*b*+ and 4*b*−.

Advantageously but not necessarily, the radiating device's 10 impedance presented to each transmit amplification chain 21, 22, 23 and respectively 24 between the respective pairs of points of the first set 1*a*+ and 1*a*−, 2*a*+ and 2*a*−, 3*a*+ and 3*a*− and respectively 4*a*+ and 4*a*− is substantially the conjugate of the output impedance of the corresponding transmit amplification chain 21, 22, 23 and the radiating device's 10 impedance presented to each receive amplification chain 31, 32, 33 and 34 between each points pair 1*b*+ and 1*b*−, 2*b*+ and 2*b*−, 3*b*+ and 3*b*− and respectively 4*b*+ and 4*b*− is substantially the conjugate of the input impedance the corresponding receive amplification chain 31, 32, 33 and respectively 34.

For greater clarity, in FIG. 5 the complete links between the respective amplification chains and the planar radiation device have not been represented. On the other hand, the excitation point to which each input of each transmit amplification chain 21 to 24 and each output of each receive amplification chain 31 to 34 is coupled has been indicated.

In transmission, an excitation signal SE applied by the electronics for generating a microwave signal at the input of the transmit/receive module 20*c* is divided into four differential excitation signals applied at the input of the respective power amplification chains 21 to 24. The four differential excitation signals are identical to within respective phases and optionally amplitudes.

The transmit circuit A comprises a splitter 122 making it possible to divide the common excitation signal SE into two excitation signals that may be asymmetric as in FIG. 1 or symmetric (that is to say differential or balanced), respectively injected at the input of respective transmission phase-shifters 25, 26. Each phase-shifter 25, 26 delivers a differential signal (as in FIG. 5) or an asymmetric signal. The signal exiting the first transmission phase-shifter 25 is divided and injected at the input of the chains 21 and 23. The signal exiting the second transmission phase-shifter 26 is divided and injected at the input of the chains 22 and 24.

The respective transmit amplification chains 21 to 24 are advantageously coupled to the respective excitation points so that the elementary waves generated by the pair 1*a*+, 1*a*− and the pair 3*a*+, 3*a*− are polarized in the same sense and so that the elementary waves excited by the pair 2*a*+, 2*a*− and the pair 4*a*+ and 4*a*− are polarized in the same sense. Thus, the electric fields of the excitation signals applied to the pairs 1*a*+, 1*a*− and 3*a*+, 3*a*− exhibit the same sense. Thus, the two pairs of points 1*a*+, 1*a*− and 3*a*+, 3*e* make it possible to deliver one and the same signal as on the basis of two points excited in an asymmetric manner. The power having to be delivered by each amplification chain 21 and 23 is divided by two and the current having to be delivered by this amplification chain 11 is then divided by the square root of two. The ohmic losses are lower and the power amplifiers easier to produce (less powerful). Likewise, the electric fields of the excitation signals applied to the pairs 2*a*+, 2*a*− and 4*a*+, 4*a*− have the same sense.

The transmit circuit A comprises transmission-wise phase-shifting means 25, 26 comprising at least one phase-shifter, making it possible to introduce a first phase-shift, so-called first transmission-wise phase-shift, between the signal applied to the first pair 1*a*+, 1*a*− and the signal applied to the second pair 2*a*+, 2*a*− and to introduce this same first transmission-wise phase-shift between the signal applied to the pair 3*a*+, 3*a*− and the signal applied to the pair 4*a*+, 4*a*−. The elementary excitation signals injected at the input of the chains 21 and 23 are in phase. The elementary excitation signals injected at the input of the chains 21 and 24 are in phase.

Advantageously, the first transmission-wise phase-shift is adjustable. The array antenna advantageously comprises an adjustment device 35 making it possible to adjust the first transmission-wise phase-shift so as to introduce a first predetermined transmission-wise phase-shift.

Each pair of excitation points generates an elementary wave. With the first transmission-wise phase-shift, the elementary waves transmitted by the pairs 1*a*+, 1*a*− and 3*a*+, 3*a*− are phase-shifted with respect to the elementary waves transmitted by the pairs 2*a*+, 2*a*− and 4*a*+, 4*a*−. By recombining the elementary waves in the air, a total wave is obtained, the polarization of which can be varied by varying the first transmission-wise phase-shift. Examples of relative phases between the transmission signals injected on the conductors coupled to the respective coupling points are given in the table of FIG. 6 together with the polarizations obtained. The vertical polarization is the polarization along the axis z represented in FIG. 5. Two points excited in phase opposition, with phases separated by 180°, have opposite instantaneous electrical excitation voltages. By way of example, the first row of the table of FIG. 6 illustrates the case where the conductors coupled to the points 1*a*+, 2*a*+, 3*a*+, 4*a*+ are raised to one and the same electrical voltage and the conductors coupled to the points 1*a*−, 2*a*−, 3*a*−, 4*a*− are raised to one and the same voltage, opposite to the previous voltage. The voltage differential is then symmetric with respect to the straight line D3. The polarization is therefore oriented along this straight line, oriented vertically. The +45° linear polarization is obtained by exciting just the pair 1*a*+, 1*a*− and the pair 3*a*+, 3*a*− with differential excitation signals in phase without exciting the pairs 2*a*+, 2*a*− and 4*a*+, 4*a*−. This is for example achieved by adjusting the gain of the amplifiers 114 so that they deliver zero power. To this end, the amplifiers exhibit a variable gain and means, not represented, for adjusting the gain. In the example of the fifth row, the phase-shifts between the points remain the same over time. The evolution of the phases over time produces a right circular polarization.

In reception, reception signals received by the pairs of respective excitation points 1*b*+ and 1*b*−, 2*b*+ and 2*b*−, 3*b*+ and 3*b*−, 4*b*+ and 4*b*− are respectively applied at the input of the respective transmit amplification chains 31, 32, 33, 34. Each receive amplification chain delivers a differential signal. As a variant, the receive amplification chain comprises a combiner so as to deliver an asymmetric signal.

The elementary reception signals exiting the chains 31 and 33 are injected at the input of a first reception phase-shifter 29 and exiting the chains 32 and 34 are injected at the input of a second reception phase-shifter 30. These phase-shifters 29, 30 make it possible to introduce a first reception-wise phase-shift between the reception signals delivered by the chains 31 and 33 and those delivered by the chains 32 and 34. The reception signals exiting the reception phase-shifters 29, 30 are summed by means of a summator 220 of the module 20, before the resulting reception signal SS is sent to the remotely sited acquisition electronics.

Thus, the receive circuit B comprises reception-wise phase-shifting means 29, 30 make it possible to introduce a first reception-wise phase-shift between reception signals arising from the pairs 1*b*+, 1*b*− and 2*b*+, 2*b*− and between the reception signals arising from the pairs 3*b*+, 3*b*− and 4*b*+, 4*b*−. In the nonlimiting embodiment of FIG. 1, these means are situated at the output of the chains 31 to 34.

Advantageously, the first reception-wise phase-shift is adjustable. The device advantageously comprises an adjustment device making it possible to adjust the reception-wise phase-shift which is the device 35 in the nonlimiting embodiment of FIG. 5.

The relative phases introduced by the transmission-wise phase-shifting means 25, 26 can be the same as those introduced by the reception-wise phase-shifting means 29, 30. This makes it possible to receive elementary waves exhibiting the same phases as the elementary waves transmitted and thus to make measurements on a total reception wave exhibiting the same polarization as the total wave transmitted by the elementary antenna. As a variant, these phases may be different.

Advantageously, these phases may advantageously be independently adjustable. This makes it possible to transmit and to receive signals exhibiting different polarizations.

As a variant, the number of phase-shifters is different and/or the phase-shifters are disposed elsewhere be it at the input of the power amplification chains or at the output of the low-noise amplification chains.

Advantageously, the antenna comprises so-called pointing phase-shifting means making it possible to introduce adjustable global phase-shifts between the excitation signals applied to the points of the respective elementary antennas of the antenna and/or between reception signals arising from the points of the respective elementary antennas of the antenna.

In the nonlimiting example of FIG. 5, these means comprise a control device 36 generating a control signal destined for the adjustment means 35. The control device 36 generates a control signal SC comprising specific phase-shift signals controlling the introduction of the first phase-shifts in transmission and in reception on the signals received at the input of each transmission phase-shifter and respectively reception phase-shifter and global signals controlling the introduction of the global phase-shifts on the signals received at the input of each transmission phase-shifter and respectively reception phase-shifter. The control device 36 sends these control signals to the adjustment device 35 in such a way that it controls the phase-shifters so that they introduce these phase-shifts on the signals that they receive. The global phase-shifts make it possible, by recombination of the total waves transmitted by the elementary antennas of the array, to choose the direction of pointing of the wave transmitted by the antenna and of the wave received by the antenna. The electronic scan of an array antenna relies on the phase-shifts applied to the constituent elementary antennas of the array, the scan being determined by a phase law.

The antenna according to the invention exhibits numerous advantages.

Each transmit amplification chain 21 to 24 is able, in transmission, to apply a differential signal, and each transmit amplification chain 31 to 34 is able in reception to acquire a differential signal. Each chain already operating on the differential signals makes it possible to avoid having to interpose a component, such as a balun (for "balanced unbalanced transformer") in order to pass from a differential signal to an asymmetric signal. However, such an intermediate component degrades the power-wise efficiency. The power-wise efficiency of the device is therefore improved.

To operate with high powers, the invention uses transmit amplification chains 21 to 24 coupled to four pairwise quadrature polarization inlets and four receive amplification chains 31 to 34 coupled to four pairwise quadrature polarization inlets, each chain operating at a nominal power compatible with the maximum power acceptable by the technology implemented to fabricate same.

The power of the electromagnetic waves transmitted or received by the radiating means can therefore be greater than the nominal operating power of the chain coupled to this pair of excitation points. Each pair of excitation points of the radiating element that are excited in a differential manner generates an elementary wave. The antenna works in dual-differential on transmission and on reception. The power of the elementary wave transmitted by each pair of points is twice as great as the nominal transmission power of the transmit amplification chain 21 to 24.

This is particularly advantageous when the nominal power is close to the maximum power permitted by the technology implemented for the production of the transmit amplification chains 21 to 24. Although at the level of each excitation circuit the power remains below the maximum power, the elementary antenna makes it possible to transmit waves at a higher power.

The choice of the technology of the plane radiating device fixes the voltage to be applied to the excitation points. The higher the voltage the lower the current for equal power and impedance and the lower the ohmic losses. For identical impedance, the division of the output power by two gives rise to a division of the current by the square root of two. The proposed solution forming the sum of the power directly on the patch or radiating element 11*c*, the ohmic losses are therefore greatly decreased.

As specified previously, the energy summation is carried out directly at the level of the excitation points. Therefore, in order to transmit four times as much power, it is not necessary to provide transmit amplification chains exhibiting amplifiers that are four times as powerful. Neither is it necessary to sum outside the radiating means signals arising from amplifiers of limited power, for example by means of ring summators or Wilkinson summators. The invention makes it possible to limit the number of conductors used as well as the ohmic losses in the conductors and consequently the power generate to compensate these losses. Neither is it necessary, in order to limit the losses, to do the energy summations in the MMICs. If the summations are done in the MMICs, the losses have to be dissipated in this already critical location. The heating of the antenna and the ohmic losses are thereby reduced.

Moreover, by exciting the excitation points of each pair in a differential manner, each pair of points transmits an elementary wave in linear polarization. By applying a phase-shift between the excitation signal of the first pair of points 1*a*+, 1*a*− and of the third pair of points 3*a*−, 3*a*+ and the excitation signals of the second pair of points 2*a*+, 2*a*− and of the fourth pair of points 4*a*+, 4*a*− orthogonal to the first and to the third pair of points 1*a*+, 1*a*− and 3*a*−, 3*a*+, the radiating element 11*c* is able to generate by itself a polarized wave by recombination of the four elementary waves in space.

This makes it possible to avoid the use of polarization selection switches interposed between the transmit/receive module 20*c* and the radiating element so as to choose a direction in which the radiating element must be excited. This also makes it possible to connect this module 20*c* directly to the excitation points and thus to increase the power efficiency, that is to say to limit the losses. The heating of the elementary antenna is thus reduced.

Moreover, the recombination in space of the four elementary waves transmitted by the radiating element leads to a total wave whose power is four times greater than the power of each elementary wave.

In reception, the incident total wave is decomposed into four elementary waves sent to the respective low-noise amplification chains 31 to 34 and is reconstructed by summation. An elementary wave possesses a power that is four times lower than the incident total wave. This allows the antenna to be more robust in relation to outside assaults, such as illuminations of the antenna by a device carrying out intentional or unintentional jamming.

The risks of deterioration of the low noise amplifiers 116 are limited. For example, the assaults of the strong fields will be reduced, due to the fact that the elementary signals are not received in the optimal polarization but at 45° (when the transmissions are either Horizontally or Vertically polarized but not obliquely). The antenna of FIG. 5 allows measurements to be made under cross-polarization, Horizontal polarization for transmission and Vertical polarization for reception for example while not applying the same first phase-shifts in transmission and in reception.

All the advantages can be obtained by virtue of the judicious arrangement of the excitation points on the radiating plane.

Figure 7:
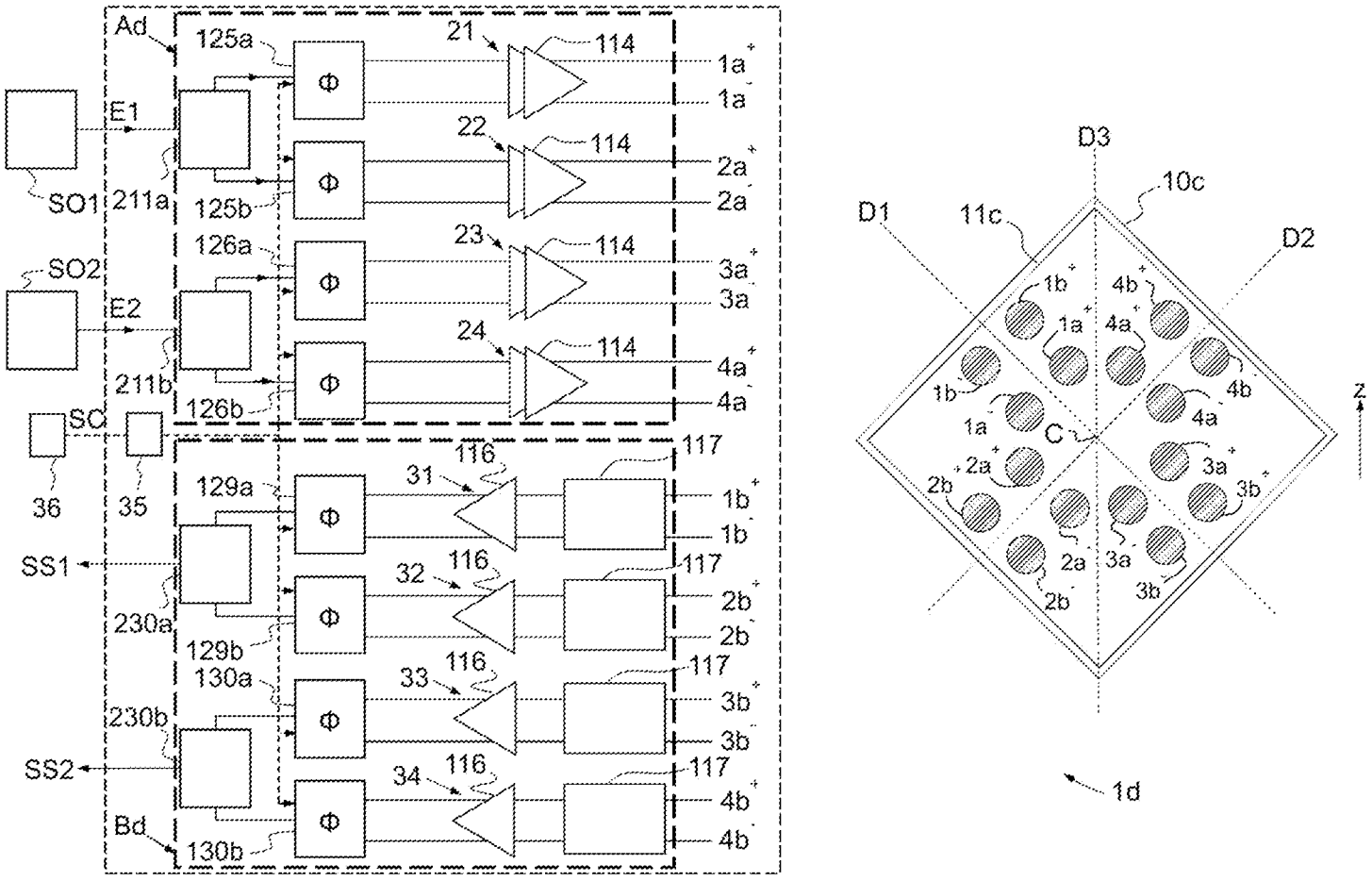

Another variant of an elementary antenna 1*d* according to the first embodiment of the invention has been represented in FIG. 7.

The planar radiating device 10*c* is identical to that of FIG. 5. The antenna comprises a transmit circuit Ad comprising the same transmit amplification chains 21 to 24 as in FIG. 5 and a receive circuit Bd comprising the same receive amplification chains 31 to 34. These chains are coupled in the same manner as in FIG. 5 to the respective pairs of excitation points.

On the other hand, the transmit/receive module 20*d* differs from that of FIG. 5 by the phase-shifting means. It comprises transmission-wise phase-shifting means comprising at least one phase-shifter making it possible to introduce a first transmission-wise phase-shift between the excitation signals applied to the pairs of excitation points 1*a*+, 1*a*− and 2*a*+, 2*a*− and a second transmission-wise phase-shift between the excitation signals applied to the pairs of points 3*a*+, 3*a*− and 4*a*+, 4*a*−, it being possible for these two transmission-wise phase-shifts to be different. This makes it possible to transmit waves exhibiting different polarizations by means of the two quadruplets of points.

In the nonlimiting example represented in FIG. 7, these transmission-wise phase-shifting means comprise a first transmission phase-shifter 125*a* and a second transmission phase-shifter 125*b* receiving one and the same signal, optionally to within an amplitude, and each introducing a phase-shift on the received signal so as to introduce the first transmission-wise phase-shift between the excitation signals applied to the pair 1*a*+, 1*a*− and to the pair 2*a*+, 2*a*−. The phase-shifting means comprise a third 126*a* and a fourth 126*b* transmission phase-shifter receiving one and the same signal, optionally, to within an amplitude, and each applying a phase-shift to the signal so as to introduce the second phase-shift between the excitation signals applied to the pair 3*a*+, 3*a*− and to the pair 4*a*+, 4*a*−. The first and the second transmission-wise phase-shift may be different. The excitation signals arising from the phase-shifters 125*a* and 125*b* are injected respectively at the input of the chains 21 and 22. The excitation signals arising from the phase-shifters 126*a* and 126*b* are injected respectively at the input of the chains 23 and 24. It is thus possible to simultaneously transmit two beams exhibiting different polarizations by means of the two quadruplets of points.

The receive circuit Bd comprises reception-wise phase-shifting means 129*a*, 129*b*, 130*a*, 130*b* making it possible to introduce a first reception-wise phase-shift between the excitation signals applied to the pairs of excitation points 1*b*+, 1*b*− and 2*b*+, 2*b*− and a second reception-wise phase-shift between the excitation signals applied to the pairs of points 3*b*+, 3*b*− and 4*b*+, 4*b*−, it being possible for these two phase-shifts to be different. The reception signals exiting the respective receive amplification chains 31 to 34 are injected into respective reception phase-shifters 129*a*, 129*b*, 130*a*, 130*b* each making it possible to introduce a phase-shift on the signal that it receives. Each reception signal is injected into one of the phase-shifters.

Advantageously, the phase-shifts introduced between the excitation and/or reception signals of the pairs of points 1*a*+, 1*a*− and 2*a*+, 2*a*− and/or 1*b*+, 1*b*− and 2*b*+, 2*b*− and between the pairs 3*a*+, 3*a*− and 4*a*+, 4*a*− and 3*b*+, 3*b*− and 4*b*+, 4*b*− are identical. As a variant, these phase-shifts may be different. This makes it possible to transmit and/or to receive two waves whose polarizations may be different.

Advantageously, the phase-shifts are adjustable.

Advantageously, the phase-shifts introduced between the transmission and/or reception signals applied to the pairs of points 1*a*+, 1*a*− and 2*a*+, 2*a*− and/or arising from the pairs 1*b*+, 1*b*− and 2*b*+, 2*b*− and between the signals applied to the pairs 3*a*+, 3*a*− and 4*a*+, 4*a*− and/or originating from the pairs 3*b*+, 3*b*− and 4*b*+, 4*b*− may advantageously be adjusted independently. It is then possible to independently adjust the polarizations of the elementary waves transmitted by the first quadruplet of points 1*a*+, 1*a*−, 2*a*+, 2*a*− and by the second quadruplet of points 3*a*+, 3*a*−, 4*a*+, 4*a*− of the first set or measured by the first quadruplet of points 1*b*+, 1*b*−, 2*b*+, 2*b*− and by the second quadruplet of points 3*b*+, 3*b*−, 4*b*+, 4*b*− of the second set.

The array antenna advantageously comprises an adjustment device 35 making it possible to adjust the phase-shifts in transmission and in reception.

Advantageously, the antenna comprises so-called pointing phase-shifting means making it possible to introduce first global phase-shifts in transmission between the excitation signals applied to the first quadruplets of points 1*a*+, 1*a*−, 2*a*+, 2*a*− of the first sets of the respective elementary antennas and second global phase-shifts in transmission between the excitation signals applied to the second quadruplets of points 3*a*+, 3*a*−, 4*a*+, 4*a*− of the first sets of the respective elementary antennas of the array, it being possible for the first and second global transmission-wise phase-shifts to be different and/or first global phase-shifts in reception between the reception signals arising from the first quadruplets of points 1*b*+, 1*b*−, 2*b*+, 2*b*− of the second sets of the respective elementary antennas and second global phase-shifts in reception between the reception signals arising from the second quadruplets of points 3*b*+, 3*b*−, 4*b*+, 4*b*− of the second sets of the respective elementary antennas of the array, it being possible for the first and second global phase-shifts in reception to be different. It is then possible to simultaneously transmit two beams in two different directions and to receive two beams in two different directions.

Advantageously, the global phase-shifts in transmission of the two sets of points are adjustable.

Advantageously, the global phase-shifts in transmission and/or in reception are independently adjustable. The directions of pointing are independently adjustable.

In the nonlimiting example of FIG. 7, the pointing phase-shifting means comprise the control device 36 generating a control signal SC comprising various signals controlling the introduction of the aforementioned phase-shifts (global and non-global) to be applied to the signals received at the input of the various phase-shifters and sends these signals to the adjustment device 35 in such a way that it controls the phase-shifters so that they introduce these phase-shifts on the signals that they receive.

The device of FIG. 7 also offers the possibility of measuring a beam in one direction and of transmitting a beam in another direction simultaneously or of making two measurements in two directions simultaneously. It is possible to transmit and to receive a signal in one direction and to transmit a transmission and receive communication in another direction. It is therefore possible to carry out cross transmissions/receptions. It is possible to form a radiation pattern in reception or in transmission covering the sidelobes and the diffuse lobes so as to allow side lobe opposition (SLO) functions making it possible to protect the radar from intentional or unintentional jamming signals. It is possible to transmit at different frequencies, thereby complicating the task of Radar detectors (ESM: "Electronic Support Measures").

In the embodiment of FIG. 7, the chains coupled to the two quadruplets 1*a*+, 1*a*−, 2*a*+, 2*a*− and 3*a*+, 3*a*−, 4*a*+, 4*a*− are fed by means of two different feed sources SO1, SO2. This makes it possible to transmit two waves exhibiting different frequencies, one by means of the first quadruplet of points 1*a*+, 1*a*−, 2*a*+, 2*a*− and the other by means of the second quadruplet of points 3*a*+, 3*a*−, 4*a*+, 4*a*−, when the sources deliver excitation signals E1 and E2 of different frequencies. The antenna of FIG. 7 can thus simultaneously transmit two beams directed in two independently adjustable pointing directions at different frequencies. This possibility of pointing two beams in two directions simultaneously makes it possible to have a dual-beam equivalent: a fast-scan beam and a slow-scan beam. For example a slow beam at 10 revolutions per minute can be used in surveillance mode and a fast beam, at 1 revolution per second, can be used in tracking mode. This scan mode is not interlaced as in single-beam antennas, but may be simultaneous. The possibility of transmitting at different frequencies complicates the task of Radar detectors (ESM: Electronic Support Measures). This also allows a data link in one direction and a radar function in another direction. This embodiment also makes it possible to transmit two beams of different shapes. It is possible to transmit a narrow beam or a wide beam depending on the number of elementary antennas of the array that are excited.

The transmit/receive module 20*d* comprises a first splitter 211*a* making it possible to divide the excitation signal E1 arising from the first source SO1 into two identical signals injected at the input of the transmission phase-shifters 125*a* and 125*b*. The circuit 120 comprises a second splitter 211*b* making it possible to divide the excitation signal E2 arising from the second source SO2 into two identical signals injected at the input of the transmission phase-shifters 126*a* and 126*b*.

In the nonlimiting example of FIG. 7, the two signals arising from the first reception phase-shifter 129*a* receiving as input reception signals arising from the first pair of excitation points 1*b*+, 1*b*− and from the second reception phase-shifter 129*b* receiving as input reception signals arising from the second pair of excitation points 2*b*+, 2*b*− are summed by means of a first summator 230*a* so as to generate a first output signal SS1. The two signals arising from the third reception phase-shifter 130*a* receiving as input reception signals arising from the third pair 3*b*+, 3*b*− and from the fourth reception phase-shifter 130*b* receiving as input reception signals arising from the fourth pair of excitation points 4*b*+, 4*b*− are summed by means of a second summator 230*b* so as to generate a second output signal SS2. The signals arising from the respective summators are sent separately to the remotely sited acquisition electronics. This makes it possible to differentiate reception signals exhibiting different frequencies. The signals arising from the two quadruplets of points 1*b*+, 1*b*−, 2*b*+, 2*b*− and 3*b*+, 3*b*−, 4*b*+, 4*b*− of the second set being summed separately, it is possible to form an antenna in reception covering the sidelobes and the diffuse ones so as to allow side lobe opposition (SLO) functions making it possible to protect the radar from intentional or unintentional jamming signals.

As a variant, the two excitation signals E1 and E2 exhibit the same frequency. It is therefore possible to obtain a more powerful total wave as in the embodiment of FIG. 5 or to transmit two signals of the same frequency in two different directions and/or exhibiting different polarizations.

Figure 8:
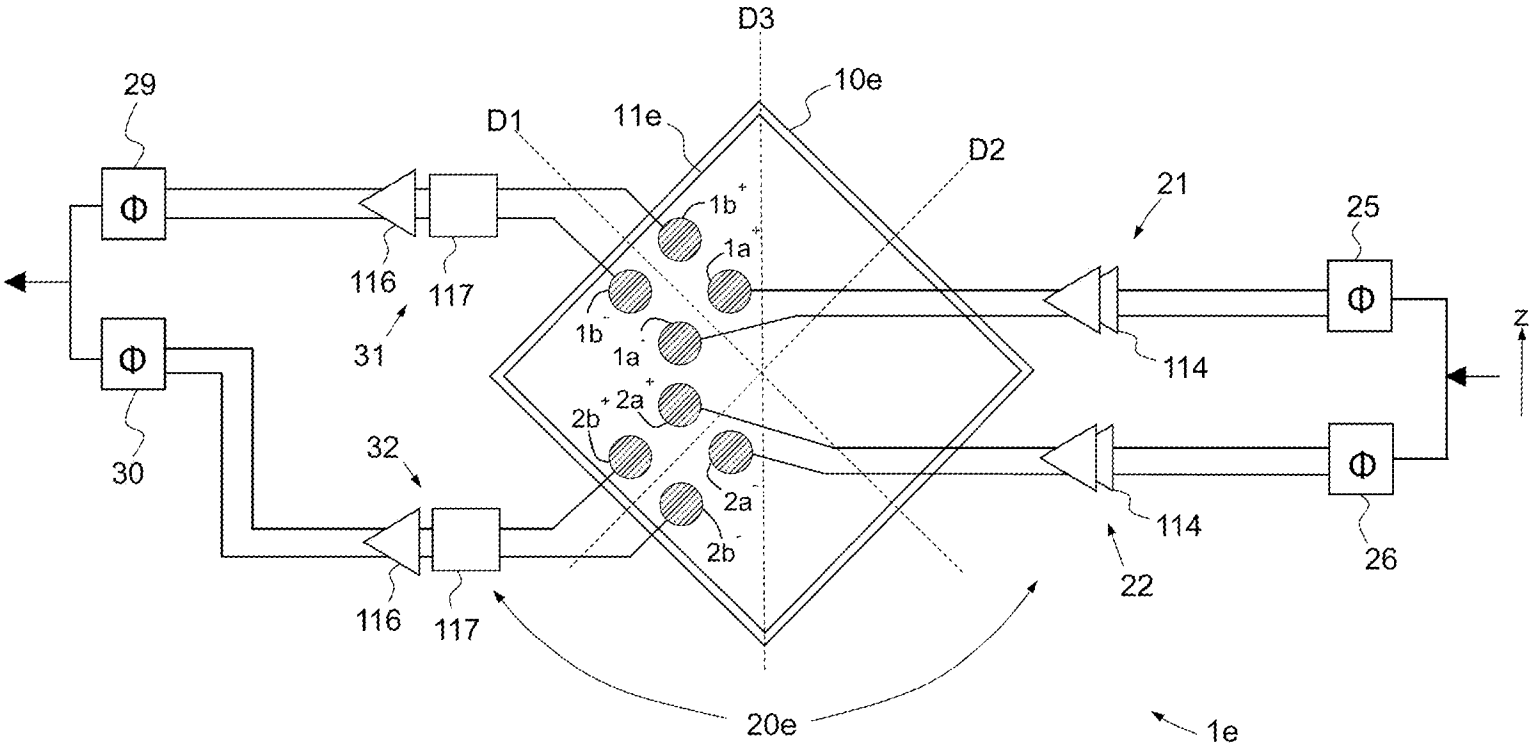

An elementary antenna 1*d* which is another variant of the first embodiment of the invention has been represented in FIG. 8.

The elementary antenna 1*d* of FIG. 8 differs from that of FIG. 5 in that the radiating element 11*e* of the radiating device 10*e* comprises a first set of points comprising just the first quadruplet of points 1*a*+, 1*a*−, 2*a*+ and 2*a*− and in that it comprises a second set of points comprising just the first quadruplet of points 1*b*+, 1*b*− and 2*b*+ and 2*b*−. The associated transmit/receive device 20*e* differs from that of FIG. 5 in that it comprises just that part of the transmit/receive device which is coupled to these excitation points. In FIG. 8, as in FIGS. 10 and 11, the adjustment device 35 as well as the control device 36 have not been represented for greater clarity. The fact of exciting the radiating element by two excitation signals applied to pairs of excitation points that are mutually in quadrature makes it possible to symmetrize the transmission/reception pattern of the elementary antenna. This elementary antenna is able to transmit a wave whose polarization is adjustable and to receive a wave in an adjustable direction of polarization. Examples of phases of the signals injected on the conductors coupled to the respective coupling points are given in the table of FIG. 9 together with the polarizations obtained. The first row is considered by way of example. The points 1*a*+ and 2*a*+ have the same excitation (same phases) and the points 1*a*− and 2*a*− have the same excitation, opposite to that of the other points. The polarization is therefore vertical, that is to say along the z axis represented in FIG. 8.

This elementary antenna also makes it possible to produce array antennas making it possible to transmit a total wave whose direction of pointing is adjustable but with half the power of that in FIG. 5.

Advantageously, the excitation points 1*a*+, 1*a*−, 2*a*+, 2*a*−, 1*b*+, 1*b*− and 2*b*+ and 2*b*− of the elementary antenna of FIG. 8 are situated on the same side of a third straight line D3 situated in the plane defined by the radiating element, passing through the central point C and being a bisector of the angle formed between the straight lines D1 and D2. When the radiating element is square and the straight lines D1 and D2 are parallel to the respective sides of the square, the third straight line joins the two vertices of the square. This makes it possible to release a half of the radiating element, in order to achieve other types of excitation for example.

Advantageously, each first quadruplet of points 1*a*−, 1*a*+ and 2*a*+, 2*a*− and 1*b*−, 1*b*+ and 2*b*+, 2*b*− of FIGS. 5 and 7 are also situated on the same side of the straight line D3.

Figure 10:
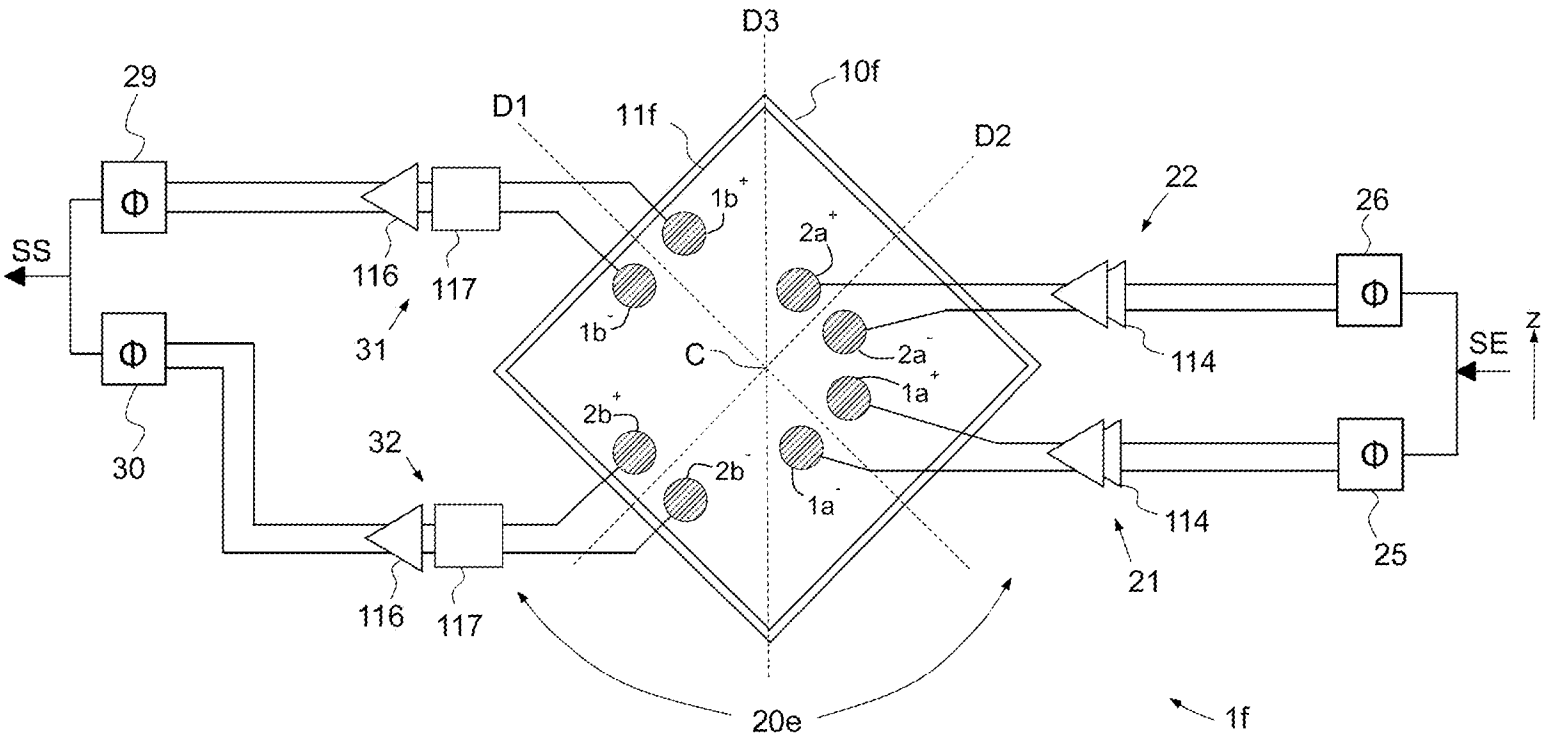

An elementary antenna 1*f* which is another variant of the first embodiment of the invention has been represented in FIG. 10. The elementary antenna of FIG. 10 differs from that of FIG. 8 by the disposition of the quadruplets of points of the two sets. More precisely, the elementary antenna of FIG. 10 differs from that of FIG. 8 in that the excitation points of the first set 1*a*−, 1*a*+ and 2*a*+, 2*a*− are situated on the other side of the third straight line D3 with respect to the excitation points of the second set 1*b*−, 1*b*+ and 2*b*+, 2*b*−. Consequently, the excitation points 1*a*+ and 1*a*− are situated on the other side of the straight line D2 with respect to the points 1*b*+ and 1*b*− and the points 2*a*+ and 2*a*− are situated on the other side of the straight line D1 with respect to the points 2*b*+ and 2*b*−. This embodiment is easier to achieve than that of FIG. 8 since the excitation points of the two sets are further apart.

An elementary antenna 1*g* which is another variant of the first embodiment has been represented in FIG. 11. This elementary antenna differs from that of FIG. 8 by the disposition of the quadruplets of points of the two sets on the radiating element 11*g* of the plane radiating device 10*g*. The disposition of the points 1*a*+, 1*a*− and 1*b*+, 1*b*− differs from that of FIG. 8 in that these points are disposed on the second straight line D2 and the disposition of the points 2*a*+, 2*a*− and 2*b*+, 2*b*− differs from that of FIG. 8 in that they are disposed on the first straight line D1. The straight lines D1 and D2 are parallel to the respective sides of the rectangular plane element which may possibly be square as in FIG. 8.

A radiating device 10*g* exhibiting a radiating element 11*g* has been represented in FIG. 12. The elementary antenna formed on the basis of this device advantageously exhibits the same transmit/receive module as in FIG. 11. This elementary antenna differs from that of FIG. 11 by the disposition of the straight lines D1 and D2 along which the two quadruplets of points extend. In this variant, the orthogonal straight lines D1 and D2 link opposite vertices of the square.

The variants of FIGS. 11 and 12 are advantageous since they make it possible to achieve the couplings of the eight excitation points by means of only two slots f1 and f2 or f3, f4 extend longitudinally along the two straight lines D1 and D2. These antennas exhibit the same advantages as the antenna of FIG. 8 in terms of gains and polarizations.

In a variant, the second set of points is identical to that of FIGS. 5 and 7: 1*a*+, 1*a*−, 2*a*+, 2*a*−, 3*a*+, 3*a*−, 4*a*+, 4*e*. The transmit/receive circuit advantageously comprises the part of the circuit 20*c* of FIG. 5 or of the circuit 20*d* of FIG. 7 that is coupled to these points. The first set of points is actually identical to that of FIG. 8: 1*b*+, 1*b*−, 2*b*+, 2*r*. The transmit/receive circuit advantageously comprises the part of the circuit 20*e* of FIG. 10 that is coupled to these points. This embodiment makes it possible to transmit at a significant power and to limit the number of excitation points and therefore of conductors used for detection when the measured power is low.

Thus, in the first embodiment, each point of the first set of points is coupled to a transmit amplification chain 110*a* and each point of the second set is coupled to a receive amplification chain 120*a*. The points of the first set are not coupled to the receive amplification chains and the points of the second set are not coupled to the transmit amplification chains.

Advantageously, the excitation points are positioned and coupled to the respective amplification chains in such a way that each amplification chain is loaded substantially by its optimal impedance. The impedance loaded on an amplification chain is advantageously the impedance of the chain formed by the radiating device, coupled to the amplification chain at the coupled excitation point or at the coupled points, and by each feed line linking the radiating device to the amplification chain.

In an advantageous embodiment, the impedances of the feed lines are negligible so that the impedance loaded on an amplification chain is substantially of the load formed by the radiating device at the excitation point or between the excitation points coupled to the amplification chain.

Advantageously but not necessarily, to optimize the efficiency, the output impedance of each transmit amplification chain coupled to one or two excitation points is substantially the conjugate of the radiating device's 10 impedance presented to said transmit amplification chain 110*a* at said point or between said points and the input impedance of each receive amplification chain 120*a* coupled to one or two excitation points is substantially the conjugate of the radiating device's impedance presented to the receive amplification chain 120*a* at the point or between said points.

Figure 13:
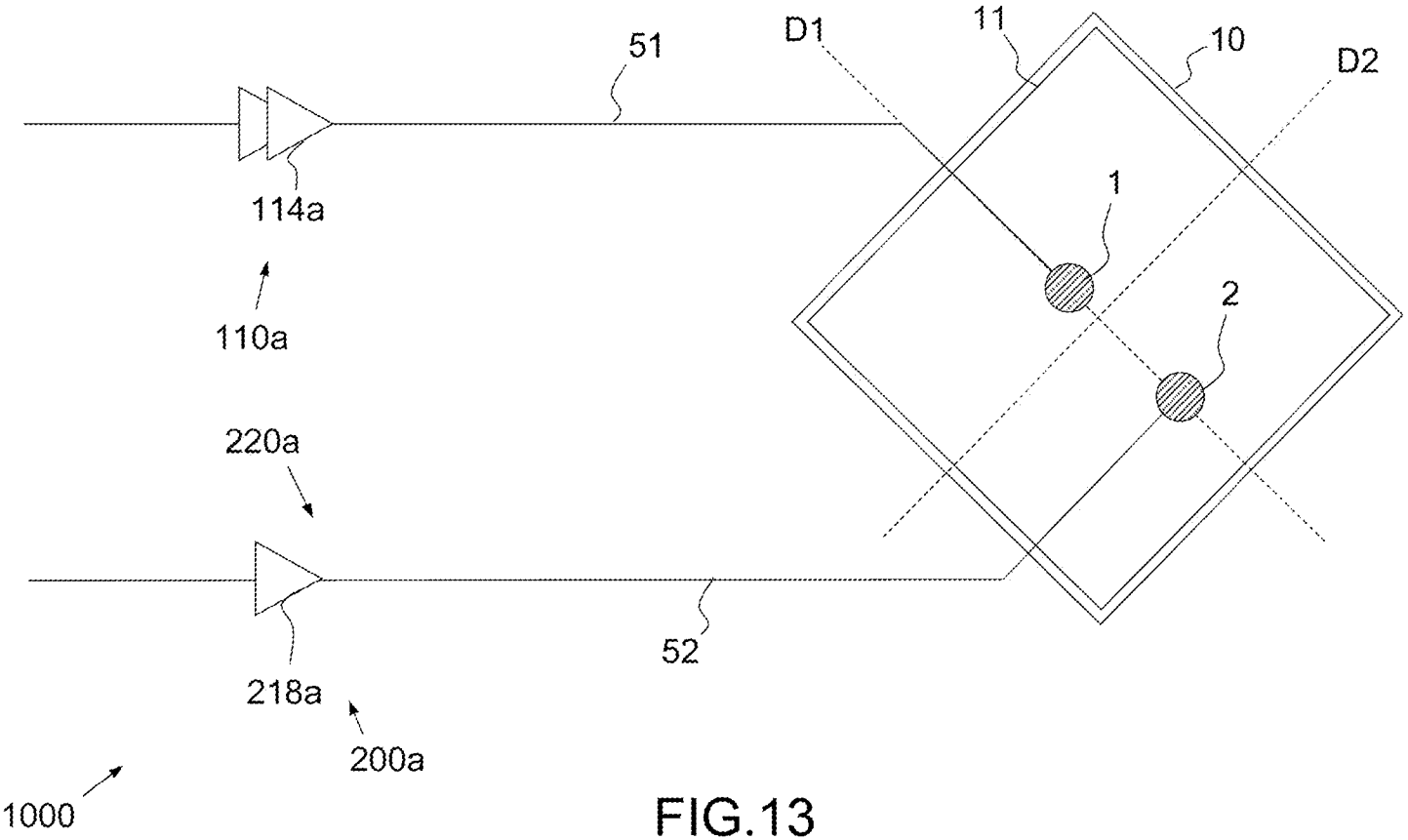
FIGS. 13 to 20 represent 7 examplary elementary antennas according to a second embodiment of the invention, FIG. 21 schematically represents reflection coefficients of the first excitation point of the antenna of FIG. 13.

A first example 1000 of a second embodiment of the antenna according to the invention has been represented in FIG. 13. This antenna comprises a planar radiating device 10 identical to that of FIG. 1. In this second embodiment, the processing module comprises a transmit circuit 200*a* comprising a so-called high-power transmit circuit able to deliver signals so as to excite the radiating element. This circuit comprises a high-power transmit amplification chain 110*a* in FIG. 13, to excite the radiating element and a low-power transmit circuit. The transmit circuit 200*a* comprises another transmit circuit which is a so-called low-power transmit circuit which is of lower power than the receive circuit. This transmit circuit comprises a so-called low-power transmit amplification chain 220*a*. The high-power transmit amplification chain 110*a* is coupled to the first point 1 and the low-power transmit amplification chain 220*a* is coupled to the second point 2.

Generally applicable to all the variants of the second embodiment, the processing circuit comprises a high-power transmit circuit able to deliver high-power signals intended to excite the radiating element, and a low-power transmit circuit able to deliver lower-power signals intended to excite the radiating element, the high-power transmit circuit being coupled to a first set of at least one excitation point of the transmit circuit and the low-power transmit circuit being coupled to a second set of at least one excitation point. These circuits are not coupled to the same points of the first and of the second set. The high-power transmit circuit comprises at least one, so-called high-power, amplification chain and the low-power transmit circuit comprises at least one, so-called low-power, amplification chain, of lower power than the high-power amplification chain. By high-power transmit amplification chain is meant a transmit amplification chain able to deliver a signal of higher maximum power than a low-power transmit amplification chain. Each high-power transmit amplification chain is coupled to one or two points of the first set of points and each low-power transmit amplification chain is coupled to one or two points of the second set. The high-power and low-power transmit chains are not coupled to common points of the first and of the second set. The power ratio between the maximum transmission powers of the two types of transmit amplification chains may typically be up to 10 dB.

The advantage of such a solution is to allow independent impedance matching for the two types of signals (high and low power) while ensuring summation of these signals directly on the radiating element (on distinct excitation points) thereby limiting the energy losses.

Provision may be made for each high-power transmit amplification chain 110*a* coupled to an excitation point so as to be able to excite it in an asymmetric manner (as in FIG. 13) or coupled to a pair of excitation points (as in the following figures) so as to excite it in a differential manner to be loaded on a substantially by its optimal impedance. This impedance loaded on a high-power amplification chain is the impedance of the chain formed by the radiating device coupled to the high-power amplification chain at the excitation point or at the excitation points and by each feed line linking the radiating device to the amplification chain at the corresponding excitation point(s). This impedance matching makes it possible to avoid the use of a specific component for transformation of impedance between the output of the high-power transmit amplification chain and its excitation point without the impedance of the low-power signals being penalizing.

In an advantageous embodiment, the impedances of the feed lines are negligible so that the impedance loaded on a high-power amplification chain is substantially the impedance of the radiating device at the excitation point or between the excitation points coupled to this amplification chain.

Advantageously, in order to achieve optimal impedance matching, the output impedance of each high-power transmit amplification chain 110*a* is substantially the conjugate of the impedance presented by the radiating device 10 to the high-power transmit amplification chain at said point or between said points, thereby making it possible to obtain a high transmission efficiency which is fundamental for high powers notably for thermal reasons.

The optimal output impedance of the transmit and receive amplification chains typically presents an impedance of 20 Ohms. Provision may be made for impedance matching for the radar signals which are powerful signals and it is possible to accept an impedance mismatch between the output of a low-power power amplification chain (delivering for example telecommunication or jamming signals) and the excitation point to which it is coupled, the energy efficiency being less significant in this case.

As a variant, the high-power and low-power transmit amplification chains exhibit distinct optimal output impedances. It is then possible to achieve the impedance matchings, described hereinabove for the high-power transmit amplification chains, for the low-power transmit amplification chains.

Each of these chains comprises at least one transmission amplifier, for example a power amplifier. A high-power transmit amplification chain comprises at least one high-power amplifier 114*a* (delivering a signal as in FIG. 1) or 114 (to delivering a differential signal) and a low-power transmit amplification chain comprises at least one lower-power transmission amplifier 218*a* (intended to receive an asymmetric signal as in 1*a*1) or 218 (to able to receive a differential signal as in the following figures).

Figure 21:
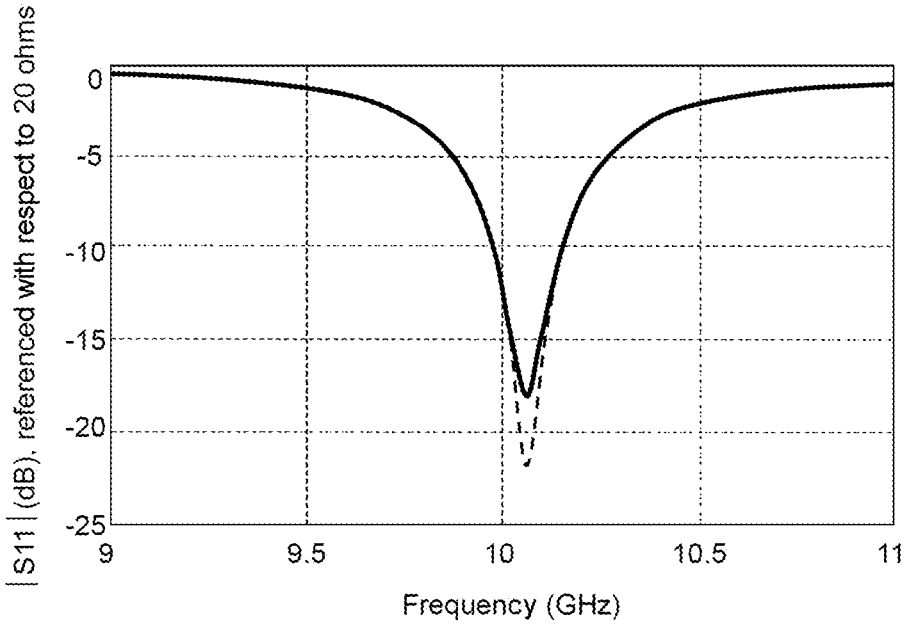

In FIG. 21, the reflection coefficient or the standing wave ratio of the feed point 1 when only this point is excited has been represented by a dashed line, and the reflection coefficient of this same point when the points 1 and 2 are excited simultaneously by their respective transmit amplification chains when the modulus of the impedance of the first port is 20 Ohms, that of the impedance of the second point 2 is 50 Ohms and that of the output impedance of the second transmit amplification chain is 500 Ohms has been represented by a solid line. It is noted that even with the latter very high impedance, the reflection coefficient of the first point is very slightly disturbed by the excitation of the second port. The signals transmitted by the two excitation points are only very slightly disturbed by one another, thereby allowing simultaneous transmission of the two types of signals.

Advantageously, each high-power transmit amplification chain exhibits a narrow passband while the low-power transmit amplification chain exhibits a wide passband. Indeed, the high-power radar signals must exhibit narrower frequency spreading than the lower-power jamming or telecommunication signals.

The antenna according to the second embodiment can exhibit several variants with plane radiating devices disposed as in the figures of the first embodiment and exhibiting an associated processing circuit. Each time, the transmit circuit comprises two transmit circuits coupled respectively to the first and to the second sets of points.

The transmit circuit of each of the respective FIGS. 14 to 20 comprises the transmit circuit of each of the respective FIGS. 1 to 12 (except FIGS. 6 and 9), which constitutes the high-power transmit circuit, coupled to the points of the first set as well as a low-power transmit circuit coupled to the points of the second set. The low-power transmit circuit is identical to the high-power transmit circuit except for the power. For example, in FIG. 13, the transmit circuit 200*a* comprises the transmit amplification chain 110*a* of FIG. 1, which here is the high-power transmit amplification chain coupled to the point 1. The transmit circuit 200*a* also comprises a low-power transmit amplification chain 220*a* coupled to the point 2.

Figure 14:
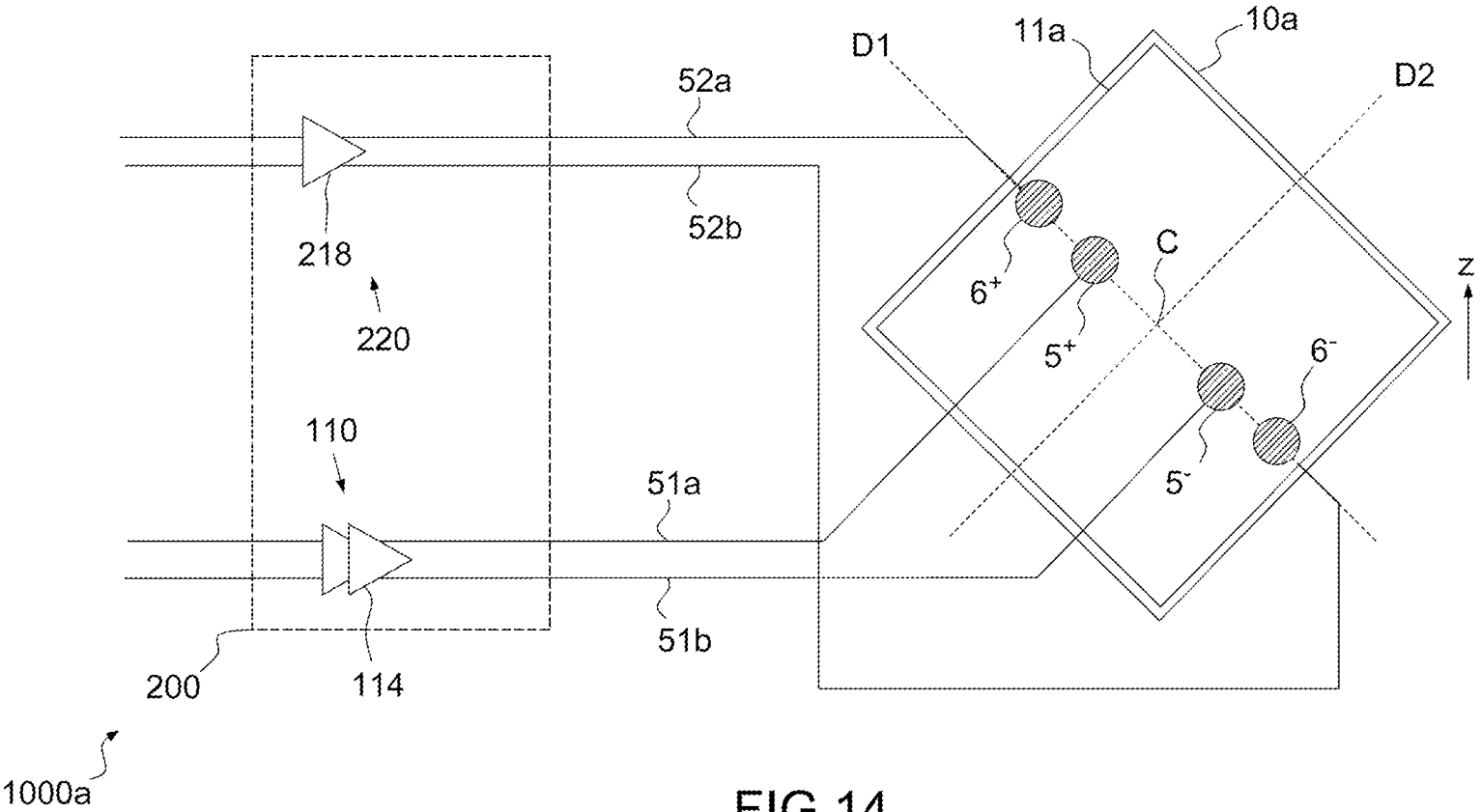

The transmit circuit 200 of the antenna 1000*a* of FIG. 14 differs from the circuit of FIG. 3 in that it comprises a low-power transmit amplification chain 220 comprising a low-power amplifier 218 coupled to the pair of points 6+, 6− of the second set so as to excite these points in a symmetric manner.

Figure 15:
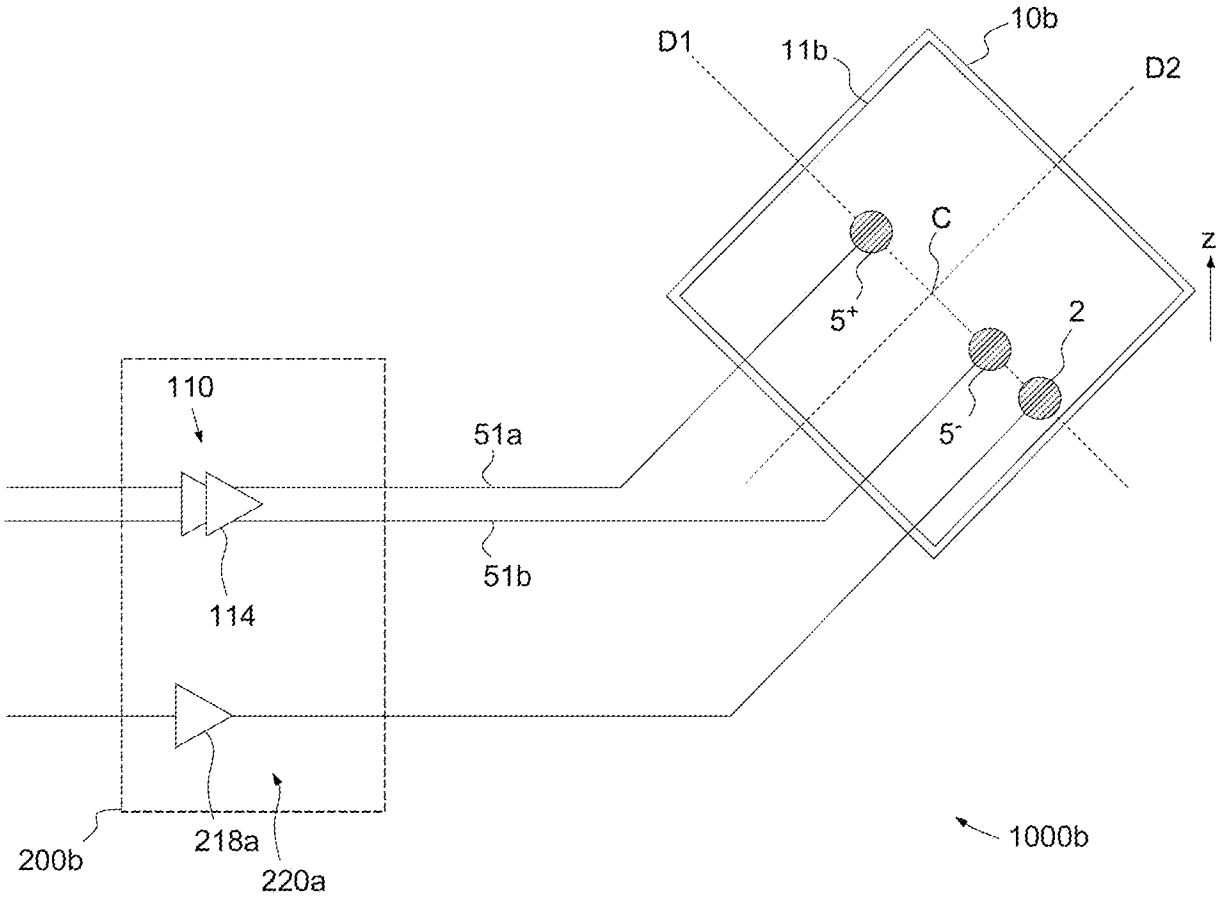

FIG. 15 represents another variant of the antenna 1000*b* combining the elements of FIGS. 13 and 14 and comprising a transmit circuit 200*b*.

Figure 16:
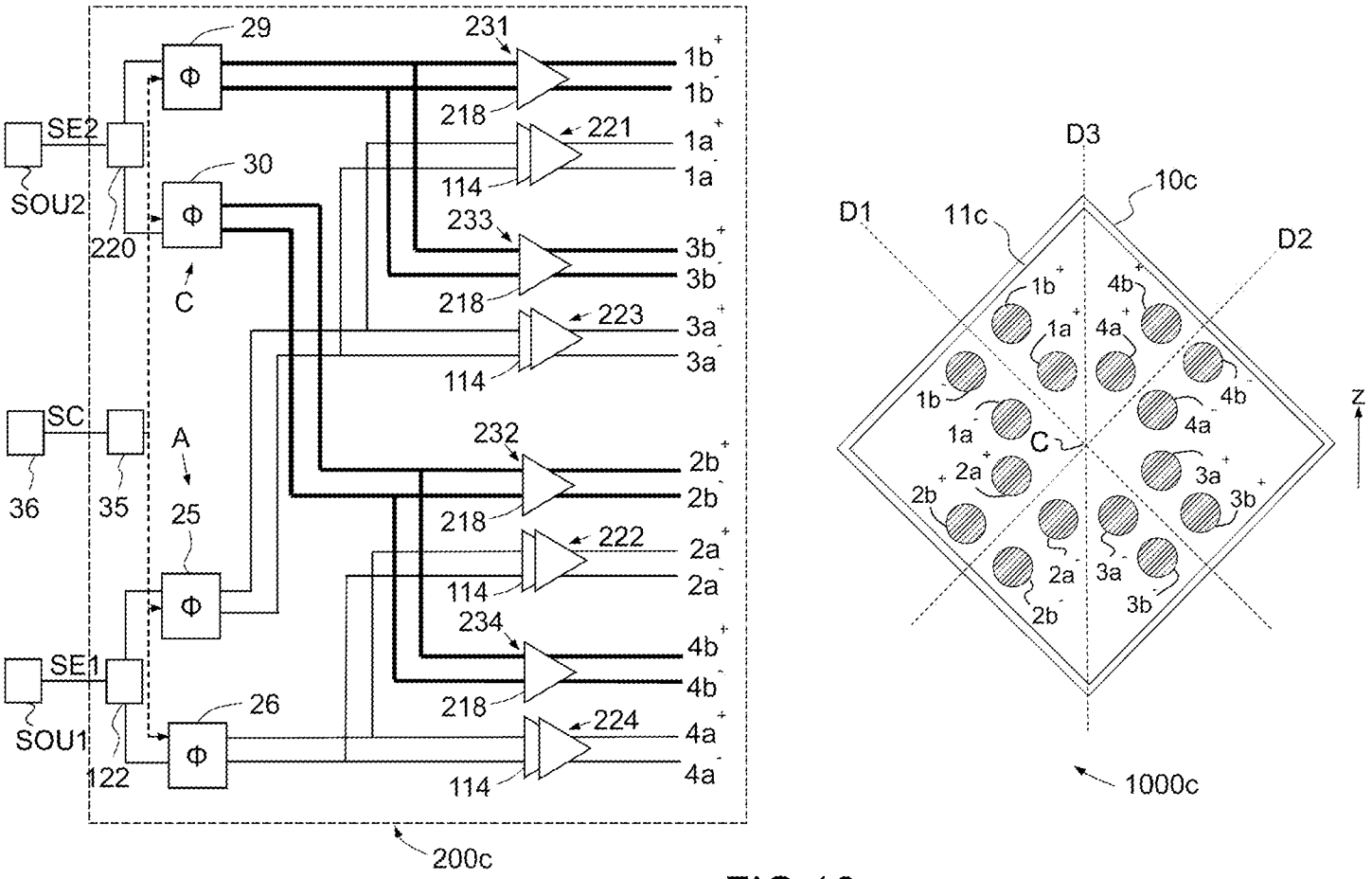

The transmit circuit 200*c* of the antenna 1000*c* of FIG. 16 differs from the circuit of FIG. 5 in that it comprises transmit circuit A of FIG. 15 coupled to the points of the first set 1*a*+, 1*a*−; 2*a*+, 2*a*−; 3*a*+, 3*a*− and 4*a*+, 4*a*−, forming the high-power transmit circuit and being fed by a source SOU1 and a low-power transmit circuit C fed by another source SOU2. The low-power transmit circuit C is identical circuit A except for the powers of the transmit amplification chains. The four transmit amplification chains of the low-power transmit circuit 231, 232, 233, 234 are coupled to the respective pairs of points 1*b*+, 1*b*−; 2*b*+, 2*b*−; 3*b*+, 3*b*− and 4*b*+, 4*b*− of the second set. The circuit C comprises transmission-wise phase-shifting means 225, 226 comprising at least one phase-shifter, making it possible to introduce a first transmission-wise phase-shift between the signal applied to the first pair 1*b*+, 1*b*− and the signal applied to the second pair 2*b*+, 2*b*− and to introduce this same first transmission-wise phase-shift between the signal applied to the pair 3*b*+, 3*b*− and the signal applied to the pair 4*b*+, 4*b*−. The signals delivered by the phase-shifter 225 are applied as input to the chains 231 and 233 and those delivered by the phase-shifter 226 are applied as input to the chains 232 and 234. The phase-shifters 225 and 226 receive as input a signal arising from one and the same source SOU2 delivering a signal split between the two phase-shifters by means of a splitter 222. Each set of points of FIG. 16 makes it possible to transmit eight times as much power as with a solution with 1 excitation point while making it possible to match the impedance in a specific manner between the high-power and low-power signals. This configuration makes it possible to control the polarization of the two types of transmission, high-power and low power, in an independent manner and to transmit these signals of different powers in two different directions. This solution makes it possible to cover the transmission sidelobes by other transmissions close to the reception band but outside of this band. This therefore makes it possible to avoid being jammed in the sidelobes. This is a weapon against repeater jammers.

Advantageously, the first transmission-wise phase-shift introduced between the excitation signals of the points of the second set of points is adjustable. This phase-shift can be adjustable independently of the first transmission-wise phase-shift introduced between the excitation signals of the first set of points. This phase-shift is advantageously adjustable by means of the adjustment device 35.

Advantageously, the pointing phase-shifting means making it possible to introduce adjustable global phase-shifts between the excitation signals applied to the points of the second sets of excitation points of the respective elementary antennas of the antenna. For example, the control device 36 generates a control signal SC comprising global signals controlling the introduction of the global phase-shifts on the signals received at the input of each phase-shifter.

Figure 17:
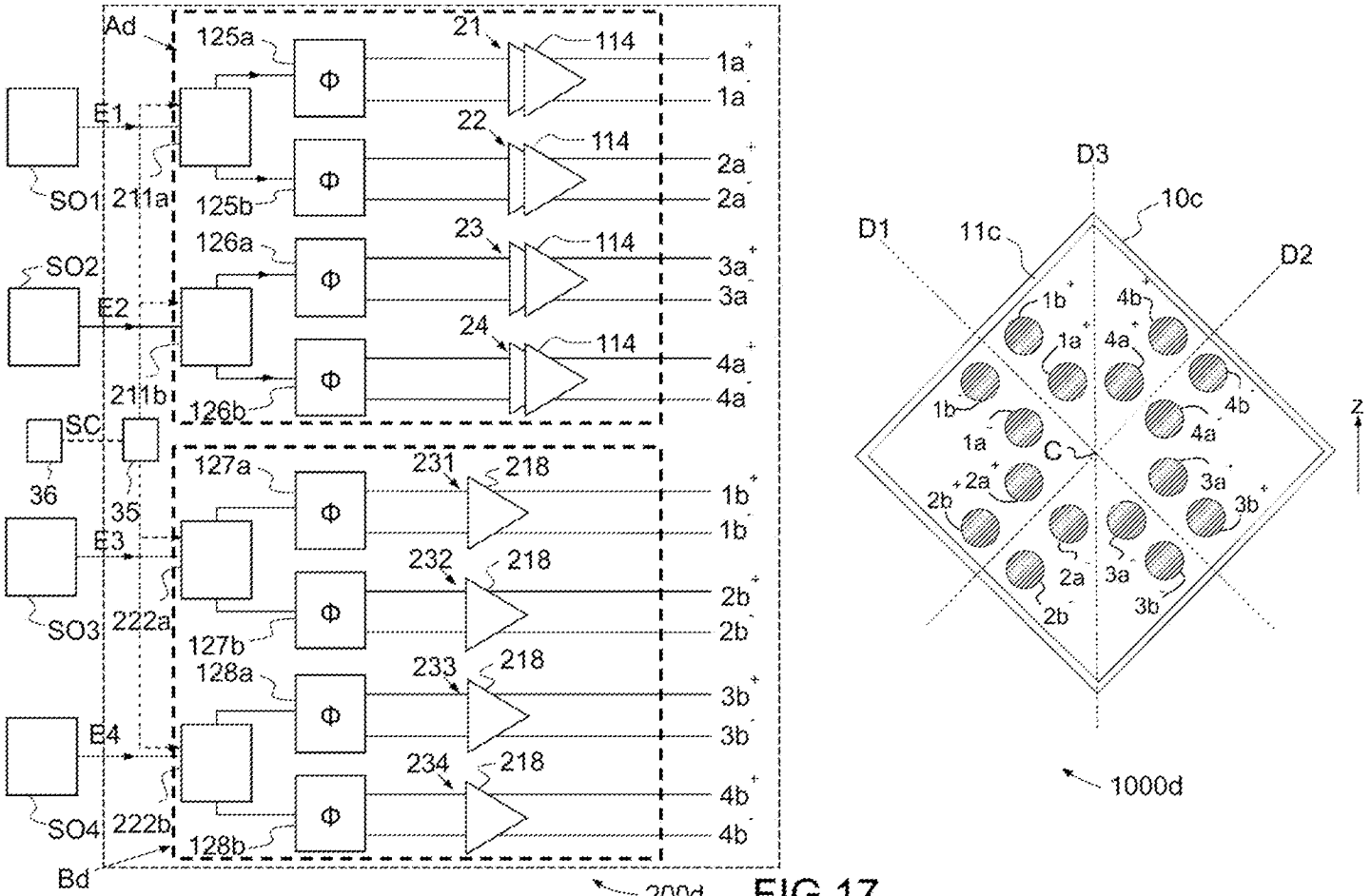

The antenna 1000*d* of FIG. 17 differs from that of FIG. 16 by the transmit circuit 200*d*. The transmit circuit 200*d* comprises a high-power transmit circuit Ad identical to that of FIG. 7. The transmit circuit 200*d* comprises a low-power transmit circuit Bd identical to the circuit Ad except for the powers and being linked to the points of the second set of points. This circuit Bd comprises four transmit amplification chains of lower power 231, 232, 233, 234 than the chains 21, 22, 23 and 24, and being respectively linked to the pairs of points 1*b*+, 1*b*−; 2*b*+, 2*b*−; 3*b*+, 3*b*− and 4*b*+, 4*b*− of the second set. The phase-shifting means make it possible to introduce a first transmission-wise phase-shift between the excitation signals applied to the pairs of excitation points 1*b*+, 1*b*− and 2*b*+, 2*b*− and a second transmission-wise phase-shift between the excitation signals applied to the pairs of points 3*b*+, 3*b*− and 4*b*+, 4*b*−, it being possible for these two transmission-wise phase-shifts to be different.

These phase-shifting means comprise four phase-shifters 127*a*, 127*b*, 128*a*, 128*b*. The two phase-shifters 127*a* and 127*b* each receive a signal arising from one and the same source SO3, apply respective phase-shifts to this signal and deliver signals at the input of the chains 231 and 232. The two phase-shifters 128*a* and 128*b* each receive a signal arising from one and the same source SO4, apply phase-shifts to this signal and deliver signals at the input of the chains 233 and 234. The signals arising from the sources SO3 and SO4 pass through respective splitters 222*a* and 222*b* before being injected at the input of the phase-shifters 127*a*, 127*b*, 128*a*, 128*b*.

The phase-shifts introduced between the excitation signals applied to pairs 1*b*+, 1*b*− and 2*b*+, 2*b*− and between the pairs 3*b*+, 3*b*− and 4*b*+, 4*b*− may be identical. As a variant these signals may be different. This makes it possible to transmit and to receive two waves whose polarizations may be different by means of the second set of points.

Advantageously, the phase-shifts are adjustable.

The phase-shifts introduced between the transmission signals applied to the pairs of points 1*b*+, 1*b*− and 2*b*+, 2*b*− and between the signals applied to the pairs 3*b*+, 3*b*− and 4*b*+, 4*b*− may advantageously be adjusted independently. The polarizations of the elementary waves transmitted by the first quadruplet of points 1*b*+, 1*b*−, 2*b*+, 2*b*− and by the second quadruplet of points 3*b*+, 3*b*−, 4*b*+, 4*b*− of the second set can then be adjusted independently.

Advantageously, the so-called pointing phase-shifting means make it possible to introduce first global phase-shifts between the excitation signals applied to the excitation signals of the first quadruplets of points 1*b*+, 1*b*−, 2*b*+, 2*b*− of the second sets of the respective elementary antennas and second adjustable global phase-shifts between the excitation signals of the second quadruplets of points 3*b*+, 3*b*−, 4*b*+, 4*b*− of the second sets of the respective elementary antennas of the array, it being possible for the first and second global phase-shifts applied to the excitation signals of the second sets to be different. It is then possible to simultaneously transmit four beams in four different directions by means of the two sets of points. One can for example two radar signals in two different directions and/or with different polarizations two jamming signals in two different directions and/or with different polarizations. One can for example carry out communication in a band, protect the lobes and the diffuse ones and also have two radar pencils in different directions. One can also have transmissions in different polarizations or with polarization agility in transmission.

Advantageously, the global phase-shifts in transmission and/or in reception are adjustable.

Advantageously, the global phase-shifts applied to the two sets of points are independently adjustable. The directions of pointing are independently adjustable.

In the nonlimiting example of FIG. 17, the pointing phase-shifting means comprise the control device 36 generating a control signal SC comprising various signals controlling the introduction of the aforementioned phase-shifts (global and non-global) to be applied to the signals received at the input of the various phase-shifters and sends these signals to the adjustment device 35 in such a way that it controls the phase-shifters so that they introduce these phase-shifts onto the signals that they receive.

Figure 18:
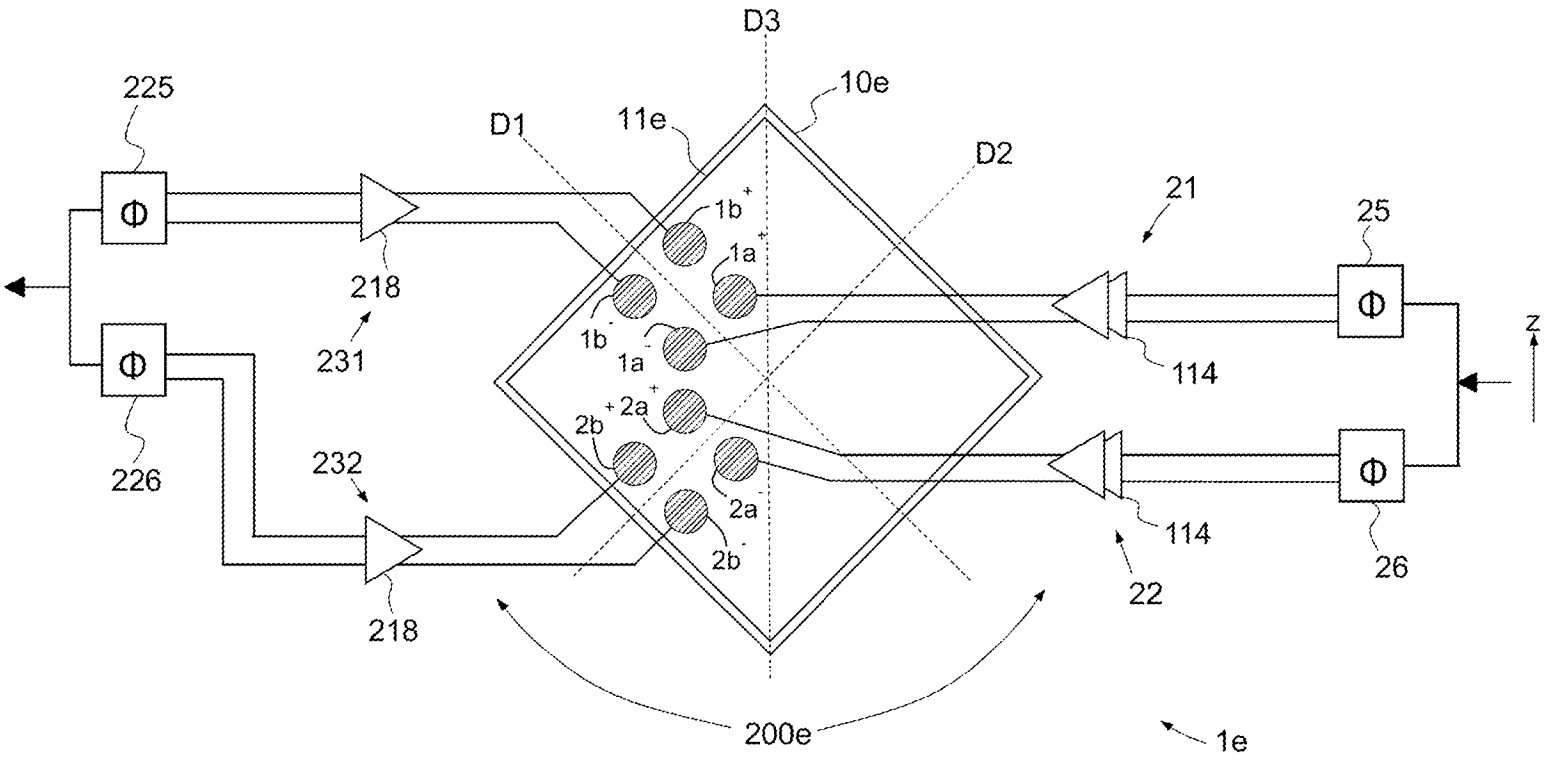
Figure 19:
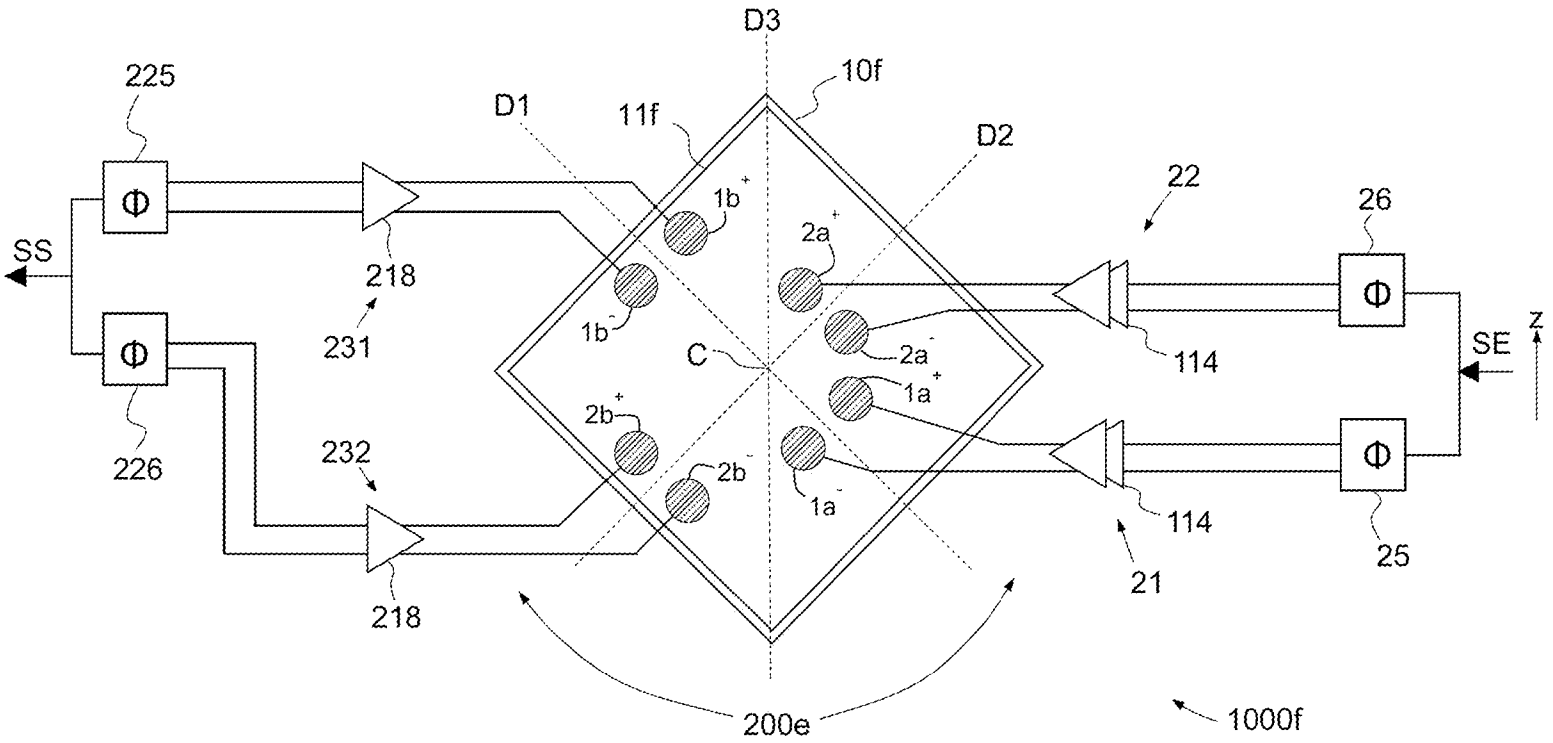
Figure 20:
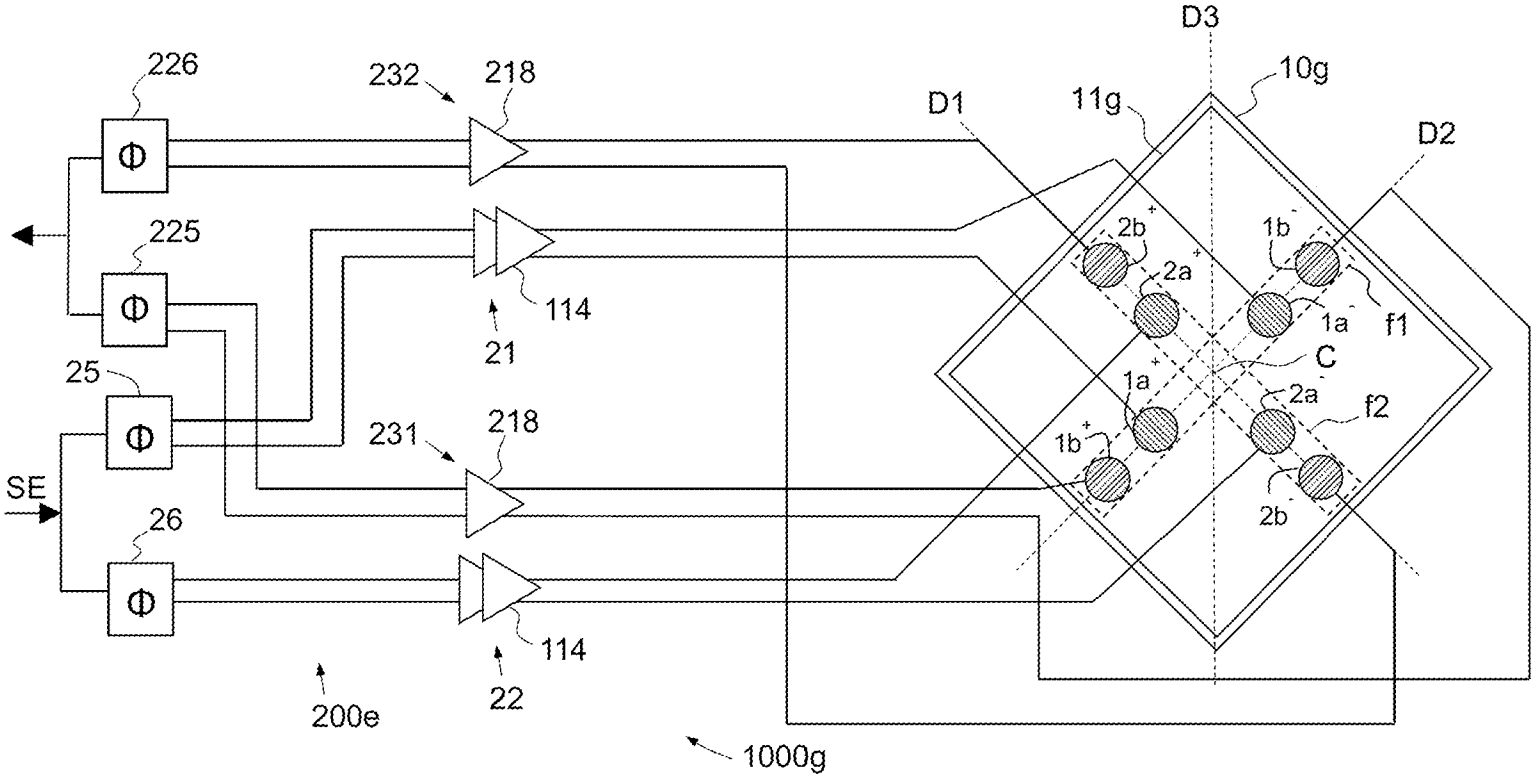

The embodiment of FIG. 18 differs from that of FIG. 16 in that the radiating element 11*e* of the radiating device 10*e* comprises a first set of points comprising just the first quadruplet of points 1*a*+, 1*a*−, 2*a*+ and 2*a*− and a second set of points comprising just the first quadruplet of points 1*b*+, 1*b*− and 2*b*+ and 2*r*−. The associated transmit circuit 200*e* differs from that of FIG. 16 in that it comprises just that part of the processing circuit that is coupled to these excitation points. FIGS. 19 and 20 differ from the embodiment of FIG. 18 by the dispositions of the excitation points identical to the dispositions of FIGS. 8 and respectively 10. A disposition of the excitation points as in FIG. 11 is also conceivable.

In FIG. 13 et seq., for greater clarity, only the receive circuit has been represented. The antenna can also comprise a receive circuit. Each point or pair of points can be coupled to a receive amplification chain in addition to the transmit amplification chain making it possible to process signals arising from the point or from the point pair. Reception-wise phase-shifting means can be provided to ensure phase-shifts between the signals arising from the same points as the phase-shifts introduced by the transmission-wise phase-shifting means on the excitation signals. This makes it possible to adjust the polarizations of the received signals. Means for introducing global phase-shifts in reception can also be provided so as to make it possible to modify the direction of pointing in reception.

In a variant, the second set of points is identical to that of FIGS. 5 and 7: 1*a*+, 1*a*−, 2*a*+, 2*a*−, 3*a*+, 3*a*−, 4*a*+, 4*e*. The transmit circuit advantageously comprises the part of the circuit 200*c* of FIG. 16 or of the circuit 200*d* of FIG. 17 that is coupled to these points. The first set of points is actually identical to that of FIG. 20: 1*b*+, 1*b*−, 2*b*+, 2*r*. The transmit circuit advantageously comprises that part of the circuit 200*e* of FIG. 20 that is coupled to these points.

Thus, in the second embodiment, each point of the first set of points is coupled to a high-power transmit amplification chain and each point of the second set is coupled to a transmit amplification chain of lower power. The points of the first set are not coupled to the low-power transmit amplification chains and the points of the second set are not coupled to the high-power transmit amplification chains.

The processing circuits are advantageously produced in MMIC technology. Preferably, an SiGe (Silicon Germanium) technology is used. As a variant, a GaAs (Gallium Arsenide) or GaN (Gallium Nitride) technology is used. Advantageously, the transmit and receive amplification chains of one and the same elementary antenna are produced on one and the same substrate. Bulkiness is thus reduced and integration of the amplification chains at the rear of the planar radiating device 10 is facilitated.

Advantageously, in embodiments not limited to those represented in the figures, each amplification chain of the first type is associated with an amplification chain of the second type. These amplification chains are coupled to respective excitation points. The excitation points are distributed so that the two mutually associated amplification chains are intended to transmit or receive, through these respective excitation points, respective elementary waves linearly polarized in one and the same direction. Stated otherwise, this direction is common to the two amplification chains. Stated otherwise, each of the mutually associated amplification chains is coupled to a set of at least one excitation point so as to transmit or detect an elementary wave linearly polarized in a direction. This direction is the same for the two mutually coupled amplification chains.

This configuration allows the elementary antenna to transmit and to detect simultaneously a total wave linearly polarized in one and the same direction or to transmit simultaneously total waves linearly polarized in one and the same direction, by means of the two types of amplification chains without phase-shifters. Yet, this mode of operation is the most commonplace. It is therefore possible, for example, to eliminate the phase-shifters from the embodiments of the figures. Stated otherwise, the amplification chains may be devoid of phase-shifters, thereby making it possible to limit the costs and the volumes of the elementary antenna and allowing a gain in integration.

Each amplification chain is coupled to a single excitation point for asymmetric excitation or to a couple of excitation points for differential excitation.

In FIGS. 1 to 4 and 13 to 15, these excitation points are disposed so as to all lie on a single of the straight lines D1 or D2. When an amplification chain is coupled to two excitation points, these points are disposed in a symmetric manner with respect to the center C. The polarizations detected or transmitted by means of these points are polarized linearly along the straight line on which the points are disposed.

In FIGS. 11 to 12 and 20, the excitation points are disposed so as to all lie on the straight lines D1 and D2. When an amplification chain is coupled to two excitation points, these points are disposed in a symmetric manner with respect to the center C. The two points of one and the same pair are disposed on one and the same straight line and are therefore intended to transmit or detect an elementary wave linearly polarized along this straight line.

The invention claimed is:

1. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct and the amplification chain of the first type being different from the amplification chain of the second type so that they exhibit different amplification properties, wherein the excitation points of the first set and of the second set exhibit distinct impedances.

2. The elementary antenna as claimed in claim 1, wherein the at least one circuit further comprises at least one of:

at least one transmit amplification chain able to deliver signals intended to excite the substantially plane radiating element, each transmit amplification chain being coupled to at least one point of the first set of at least one excitation point of said substantially plane radiating element; and at least one receive amplification chain able to amplify signals arising from the substantially plane radiating element, each receive amplification chain being coupled to at least one point of the second set of at least one excitation point of said substantially plane radiating element.

3. The elementary antenna as claimed in claim 1, wherein at least one set taken from among the first set of excitation points and the second set of excitation points comprises at least one pair of excitation points, the pair of excitation points comprising two excitation points coupled to the at least one circuit in such a way that a differential signal is intended to flow between the planar radiating device and the transmit circuit.

4. An antenna comprising several elementary antennas as claimed in claim 1, wherein the substantially plane radiating elements form an array of radiating elements.

5. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein the at least one circuit further comprises at least one of:

at least one transmit amplification chain able to deliver signals intended to excite the substantially plane radiating element, each transmit amplification chain being coupled to at least one point of the first set of at least one excitation point of said substantially plane radiating element; and at least one receive amplification chain able to amplify signals arising from the substantially plane radiating element, each receive amplification chain being coupled to at least one point of the second set of at least one excitation point of said substantially plane radiating element, wherein the excitation points of the first and second sets are positioned and coupled to the respective amplification chains in such a way that each amplification chain is loaded substantially by its optimal impedance, the impedance loaded on each amplification chain being the impedance of the chain formed by the planar radiating device coupled to the amplification chain and by each feed line coupling the planar radiating device to the amplification chain.

6. The elementary antenna as claimed in claim 5, wherein at least one of:

at least one transmit amplification chain coupled to one point or two points of the first set exhibits an output impedance which is substantially a conjugate of the planar radiating device's impedance presented to said transmit amplification chain at said one point of the first set or between the two points of the first set, and at least one receive amplification chain coupled to one point or two points of the first set exhibits an output impedance substantially conjugate to the planar radiating device's impedance presented to said amplification chain in reception at said point or between the two points of the second set.

7. An elementary antenna comprising a planar radiating device comprising a substantially plane radiating element and a transmit circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein the transmit circuit further comprises:

at least one so-called high-power transmit amplification chain able to deliver signals intended to excite the substantially plane radiating element, each high-power transmit amplification chain being coupled to at least one point of the first set of at least one excitation point of said substantially plane radiating element; and at least one second so-called low-power transmit amplification chain, of lower power than the first power amplification chain, able to deliver signals intended to excite the substantially plane radiating element, each low-power transmit amplification chain being coupled to at least one point of the second set of at least one excitation point of said substantially plane radiating element.

8. The elementary antenna as claimed in claim 7, wherein the excitation points of the first and second sets are positioned and coupled to each high-power transmit amplification chain in such a way that each high-power amplification chain is loaded substantially by its optimal impedance, the impedance loaded on each high-power amplification chain being the impedance of the chain formed by the planar radiating device coupled to the amplification chain and by each feed line coupling the planar radiating device to the high-power transmit amplification chain.

9. The elementary antenna as claimed in claim 8, wherein at least one high-power transmit amplification chain coupled to one point or two points of the first set exhibits an output impedance which is substantially a conjugate of the planar radiating device's impedance presented to said transmit amplification chain at said one point of the first set or between the two points of the first set.

10. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein the impedance of each excitation point of the first set is less than the impedance of each excitation point of the second set.

11. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein each amplification chain of the first type is associated with an amplification chain of the second type, these amplification chains being coupled to excitation points disposed so as to transmit or receive respective elementary waves linearly polarized in one and the same direction.

12. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein the substantially plane radiating element is defined by a first straight line passing through a central point of the substantially plane radiating element and a second straight line perpendicular to the first straight line and passing through the central point, the excitation points being distributed solely over at least one of the first straight line and the second straight line.

13. The elementary antenna as claimed in claim 12, wherein the excitation points are distributed solely over the first straight line and over the second straight line, the planar radiating device comprising two slots extending longitudinally according to the first straight line and the second straight line, the two slots ensuring the coupling of all the excitation points of the first and second sets.

14. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein at least one of said first set and said second set comprises a second quadruplet of excitation points situated some distance from the first straight line and from the second straight line comprising:

a third pair composed of excitation points (3*a*+, 3*e*) disposed in a substantially symmetric manner with respect to said first straight line, the points of the third pair of points (3*a*+, 3*a*−) being disposed on the other side of the second straight line with respect to the first pair of excitation points (1*a*+, 1*e*) of said at least one set, a fourth pair composed of excitation points (4*a*+, 4*a*−) disposed in a substantially symmetric manner with respect to said second straight line (132), the points of the fourth pair of points (4*a*+, 4*a*) being disposed on the other side of the first straight line with respect to the second pair of excitation points (1*a*+, 1*a*−) of said at least one set.

15. The elementary antenna as claimed in claim 14, wherein each set taken from among the first set and the second set comprises a first quadruplet of points and a second quadruplet of points.

16. The elementary antenna as claimed in claim 14, comprising phase shifters making it possible to introduce a first phase-shift between a first signal applied, or arising from, the first pair of the excitation points and a second signal applied to, or respectively arising from, the second pair of excitation points and a second phase-shift of said at least one set, which may be different from the first phase-shift, between a third signal applied to, or respectively arising from, the third pair or arising from the third pair of excitation points of said at least one set and a fourth signal applied to, or respectively arising from, the fourth pair of excitation points of said at least one set.

17. The elementary antenna as claimed in claim 14, the first quadruplet of points and the second quadruplet of points of at least one set being excited by means of signals of distinct frequencies or being summed separately.

18. An antenna comprising several elementary antennas as claimed in claim 14, comprising pointing phase shifters thereof make it possible to introduce first global phase-shifts between signals applied to the, or arising from the, first quadruplets of points of at least one set of points of the respective elementary antennas and second global phase-shifts between signals applied to the, or respectively arising from the, second quadruplets of points of said set of points of the respective elementary antennas, it being possible for the first and the second global phase-shifts to be different.

19. An elementary antenna comprising a planar radiating device comprising a substantially plane radiating element and at least one of a transmit circuit and a receive circuit comprising at least one amplification chain of a first type and at least one amplification chain of a second type, each amplification chain of the first type being coupled to at least one excitation point of a first set of at least one excitation point of the substantially plane radiating element and each amplification chain of the second type being coupled to at least one point of a second set of excitation points of the substantially plane radiating element, the excitation points of the first set and the second set being distinct, and the amplification chain of the first type being different from the amplification chain of the second type so that they exhibit different amplification properties, wherein at least one set taken from among the first set (1*a*+, 1*a*−, 2*a*+, 2*a*−) and the second set (1*b*+, 1*b*−, 2*b*+, 2*b*−) comprises at least one pair of excitation points, the pair of excitation points comprising two excitation points coupled to the at least one circuit in such a way that a differential signal is intended to flow between the planar radiating device and the transmit circuit, and wherein at least one set taken from among the first set and the second set comprises a first quadruplet of excitation points, the substantially plane radiating element being defined by a first straight line passing through a center of the substantially plane radiating element and a second straight line perpendicular to the first straight line and passing through the center, the excitation points of each first quadruplet of excitation points comprise a first pair of excitation points composed of excitation points (1*a*+, 1*a*−; 1*b*+, 1*b*−) disposed in a substantially symmetric manner with respect to said first straight line and a second pair of excitation points composed of excitation points disposed in a substantially symmetric manner with respect to said second straight line.

20. The elementary antenna as claimed in claim 19, wherein the excitation points of the first quadruplet of points are situated some distance from the first straight line and from the second straight line.

21. The elementary antenna as claimed in claim 19, wherein each set comprises a first quadruplet of excitation points situated on the first straight line and on the second straight line.

22. The elementary antenna as claimed in claim 19, wherein each set consists of a first quadruplet of points, the excitation points of each first quadruplet of points being situated on just one side of a third straight line situated in the plane defined by the substantially plane radiating element, passing through the central point and being a bisector of the angle formed by the first and the second straight line.

* * * * *